US005350473A

United States Patent [19]

Weder et al.

[11] Patent Number: 5,350,473

[45] Date of Patent: Sep. 27, 1994

[54] COVER FORMING APPARATUS HAVING PIVOTING FORMING MEMBERS

[75] Inventors: Donald E. Weder, Highland, Ill.; Paul Fantz, Imperial, Mo.

[73] Assignee: Highland Supply Corporation, Highland, Ill.

[21] Appl. No.: 982,921

[22] Filed: Nov. 30, 1992

Related U.S. Application Data

[63] Continuation-in-part of Ser. No. 927,891, Aug. 10, 1992, Pat. No. 5,291,721.

[51] Int. Cl.[5] ..... B29C 63/06

[52] U.S. Cl. ..... 156/212; 156/215; 156/245; 156/272.2; 156/443; 156/468; 156/475; 156/474; 156/492; 156/379.6; 47/72; 264/292

[58] Field of Search ..... 156/212, 213, 215, 242, 156/245, 272.2, 443, 468, 475, 483, 484, 474, 492, 379.6; 264/292; 47/66, 72

[56] References Cited

U.S. PATENT DOCUMENTS

| | | | |
|---|---|---|---|
| 1,154,969 | 9/1915 | Burnham | 156/492 |
| 1,726,929 | 9/1929 | Slocomb et al. . | |
| 1,905,489 | 4/1933 | Nelson . | |
| 1,942,017 | 1/1934 | Baldwin | 93/2 |
| 1,961,640 | 6/1934 | Miller | 93/2 |
| 2,027,010 | 1/1936 | Zeigler | 93/2 |
| 2,058,070 | 10/1936 | Elkin | 206/46 |
| 2,066,449 | 1/1937 | Barrett | 93/2 |
| 2,331,543 | 10/1943 | Emery | 93/2 |
| 2,971,312 | 2/1961 | Bell, Jr. | 53/390 |
| 3,851,439 | 12/1974 | Pillon | 53/29 |
| 4,174,988 | 11/1979 | Moore et al. | 156/492 |
| 4,733,521 | 3/1988 | Weder et al. | 53/580 |
| 4,773,182 | 9/1988 | Weder et al. | 47/72 |
| 4,835,834 | 6/1989 | Weder | 29/525 |
| 4,975,236 | 12/1990 | MacLachlan | 156/492 |
| 5,106,449 | 4/1992 | Fazzina et al. | 156/215 |
| 5,228,934 | 7/1993 | Weder et al. | 264/292 |
| 5,231,794 | 8/1993 | Weder et al. | 47/72 |

*Primary Examiner*—Caleb Weston
*Attorney, Agent, or Firm*—Dunlap Codding Lee

[57] ABSTRACT

A cover forming apparatus for forming a flower pot or flower pot cover from a sheet of material by engaging a sheet of material about the outer surface of a mold, die or pot. The cover forming apparatus includes a plurality of pivotable forming members resting in a surface which supports a sheet of material upon which is positioned a flower pot mold or flower pot. When the forming members are pivotally moved from the storage position to an extended position, the forming members cause the sheet of material to be appressed to or engaged with the mold or pot. The article formed in accordance with the present invention may be separable from the mold or pot and usable as a flower pot or flower pot cover or may be more or less securely attached to the pot by adhesive, cohesive, barbs, friction pinches or other securing means thereby forming a decorative cover connected to a flower pot. The forming members may be spaced by gaps in their closed positions, and gathering fingers can be employed in functional relationship to the forming members to produce different pot or cover features. The cover forming apparatus may be incorporated within a mobile platform enabling the cover forming apparatus to be moved from one location to another.

65 Claims, 16 Drawing Sheets

COVER FORMING APPARATUS HAVING PIVOTING FORMING MEMBERS

RELATED REFERENCES

This application is a continuation-in-part of co-pending patent application, U.S. Ser. No. 07/927,891, entitled "COVER FORMING APPARATUS HAVING PIVOTING FORMING MEMBERS", filed Aug. 10, 1992,U.S. Pat. No. 5,291,721.

FIELD OF THE INVENTION

The present invention generally relates to an apparatus for forming a cover for an object from a sheet of material and, more particularly, but not by way of limitation, to an apparatus having a plurality of pivotable forming members which can be caused to press against the sheet of material for producing flower pots or decorative covers for flower pot objects.

SUMMARY OF THE INVENTION

The present invention comprises a cover forming apparatus for forming a sheet of material about an object to produce a flower pot or flower pot cover for the object. The apparatus comprises a flower pot former or flower pot cover former having a plurality of pivotable forming members which are resiliently engageable with portions of the sheet of material and can be made to cooperate to press the sheet of material against the object. When the forming members are moved away from the object, the sheet of material remains in the shape formed thereby as a formed pot or formed cover for the object.

BRIEF DESCRIPTION OF THE DRAWINGS

FIG. 19 is a cross sectional view of the major cover forming elements taken along the line 19—19 in FIG. 20.

DESCRIPTION OF THE PREFERRED EMBODIMENTS OF FIGS. 1–15

Figure 1:
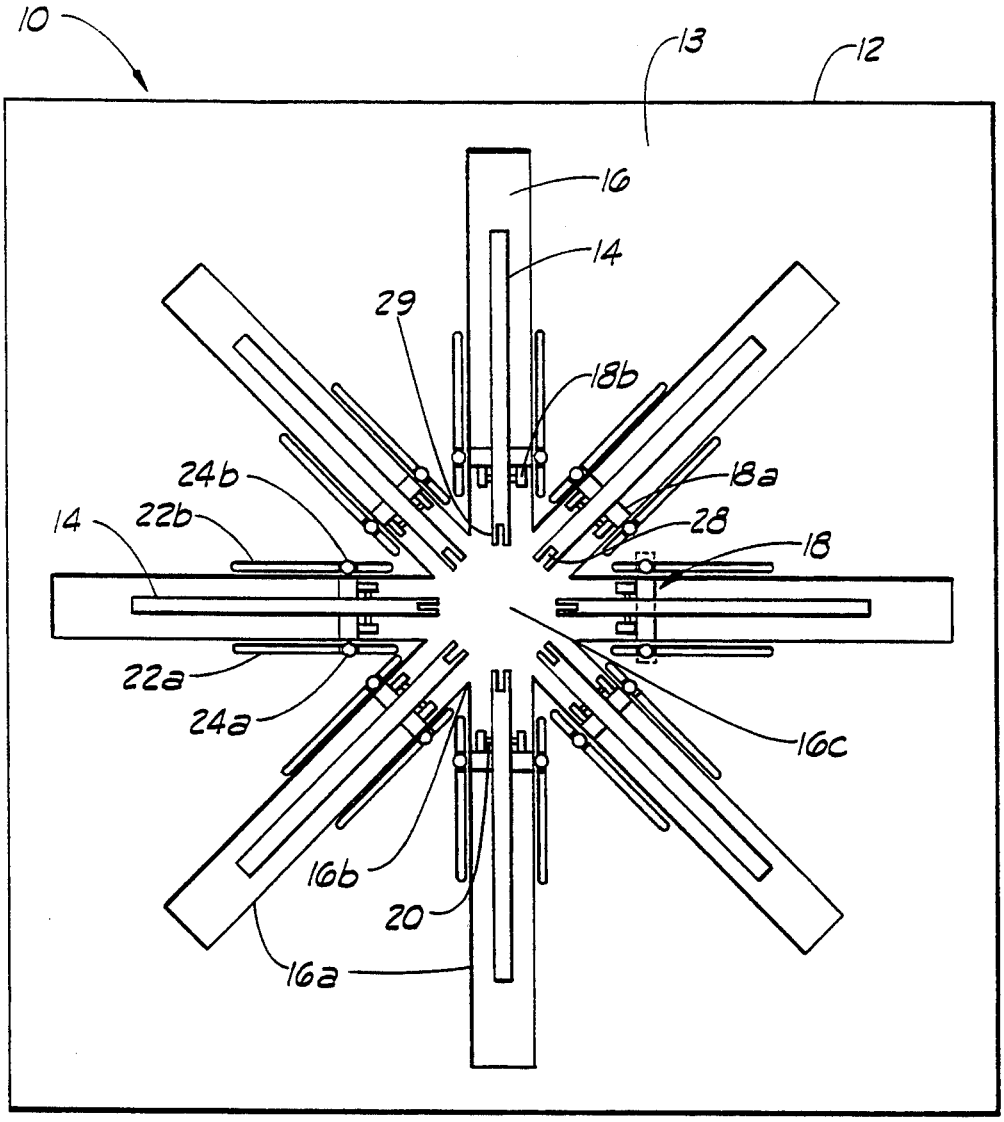
FIG. 1 is a plan view of a cover forming apparatus having eight forming members.
Figure 2:
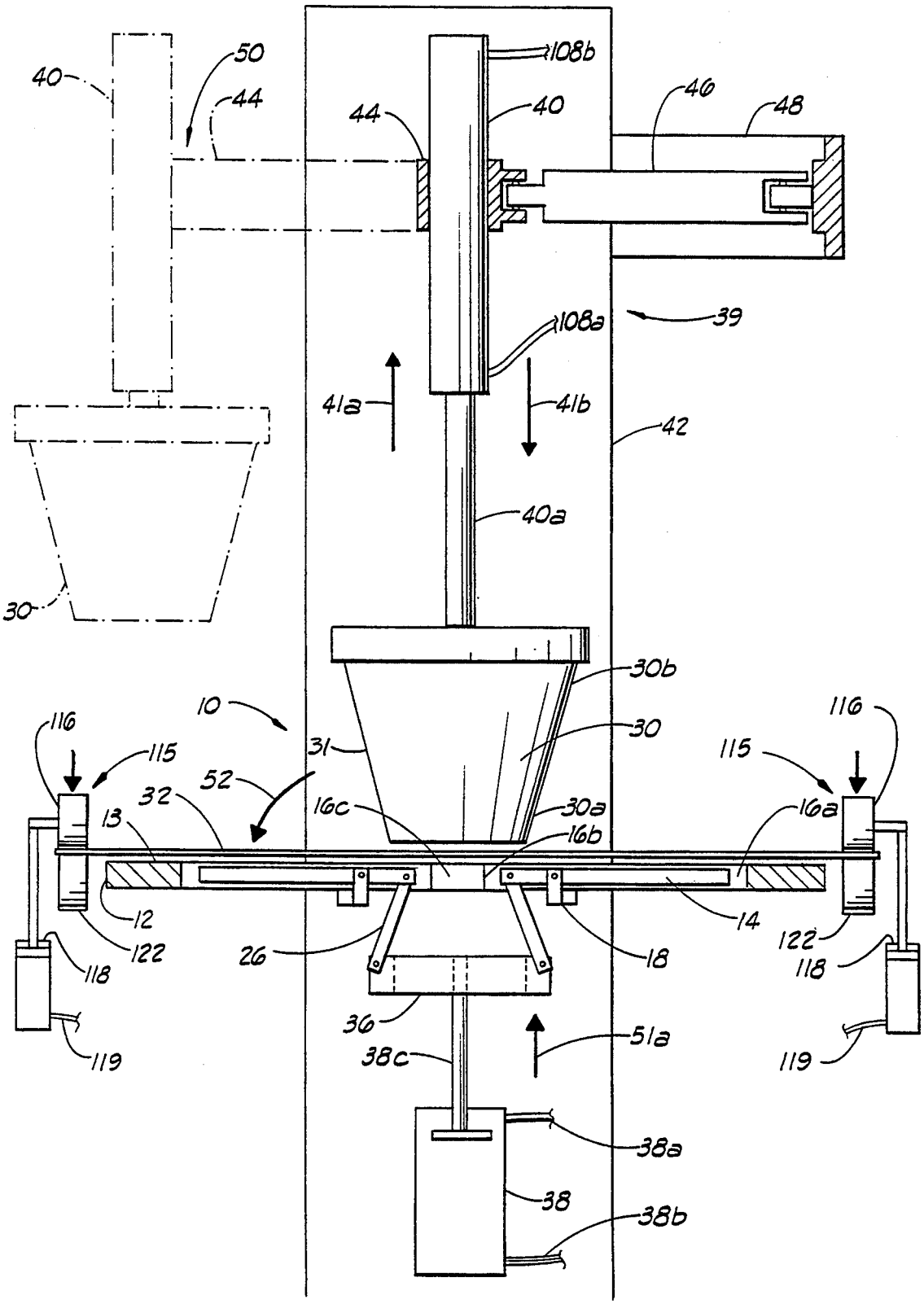
FIG. 2 is a side elevational, partial sectional, diagrammatic view of a cover forming apparatus including a mold support assembly.
Figure 3:
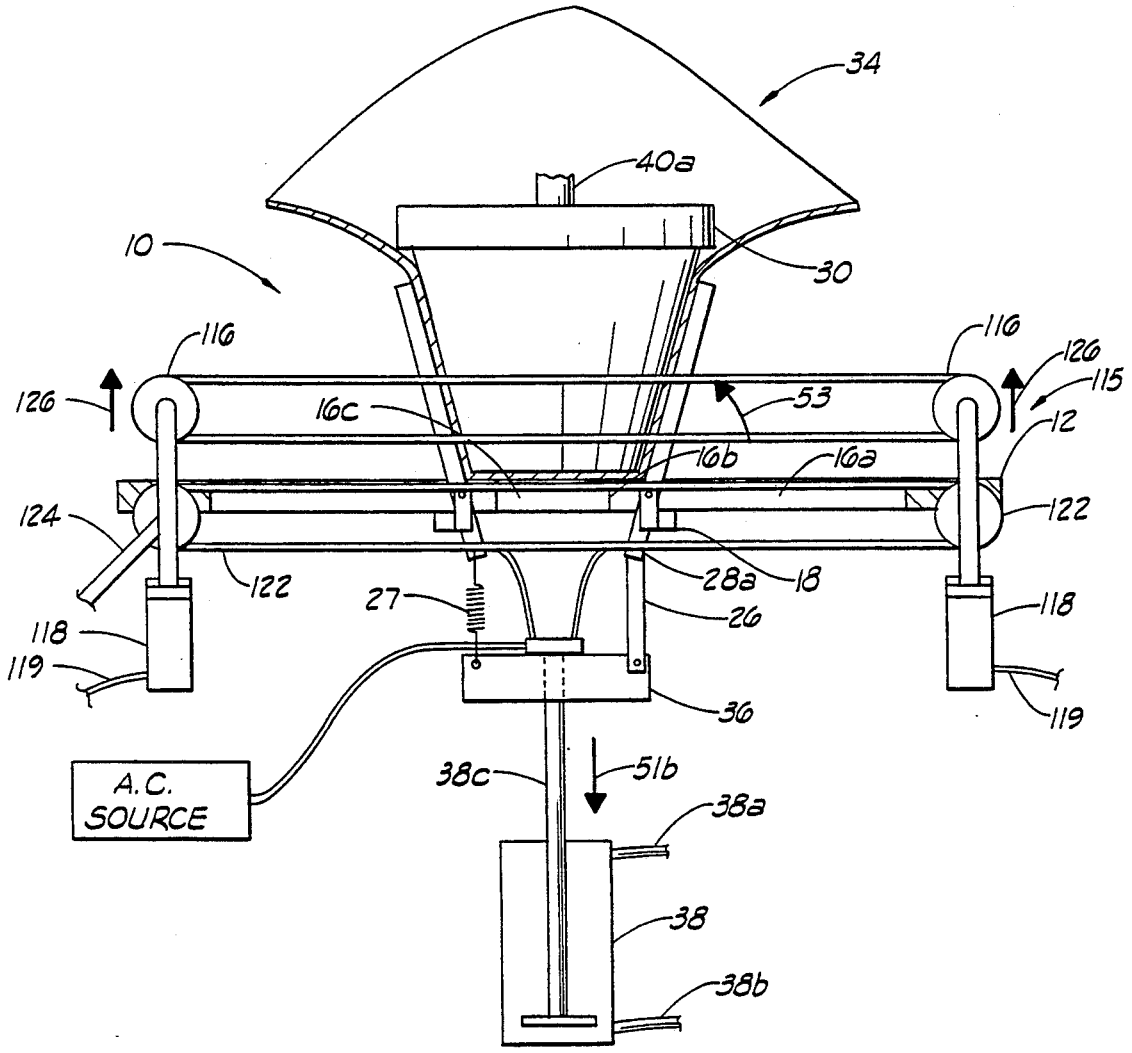
FIG. 3 is a side elevational, partial sectional view of a cover formed by a forming apparatus having forming members in the extended position.

Shown in FIGS. 1, 2 and 3 is a forming apparatus 10 designed to form flower pots or flower pot covers from sheets of flexible material. Such articles have gained wide use in the flower and plant wholesaling and retailing industry. The present invention contemplates a flower pot or flower pot cover forming apparatus which is quite different from any currently used or known pot or cover forming system in that in the present invention the article 34 is formed by pushing the sheet of material 32 peripherally up and around the forming mold or pot 30 with a plurality of discrete pivoting forming members. This method reduces the shear forces which are induced between the inner surface of the female pot or mold and the material and which can act on the material to tear, rip, strip, lacerate, deface or otherwise mar or mutilate the material during the forming process if the material is thin, fragile or decorated in a delicate way. The present invention solves that problem because the pot or die does not shear against the sheet of material but rather acts to receive the sheet of material as the sheet is pressed against the outer surface of the pot or die by the forming members.

Another problem solved by the present invention is that pots which are already filled with plants and potting material, a typical situation in a retail business, can be more easily manipulated in the process of being covered. Using the forming apparatus, the pot can simply be placed on a support surface such as the support surface 12 over a sheet of material 32 which is placed on the upper surface 13 of the support surface 12 and the forming members of the forming apparatus 10 pivotally actuated to form the pot cover 34. This reduces the need for manual handling of a soil filled pot or one laden with delicate flowers or foliage which could suffer from the manipulation required to deposit the pot into a cover forming device adapted for manual handling such as a pot wrap stand. Moreover, the positions of the forming members of the various embodiments of the present invention are readily adjustable so that a wide range of pot sizes can be easily and quickly accommodated. In addition, the cover forming apparatus can be made mobile to allow the movement of the apparatus from place to place within a potted plant storage or growing facility.

Figure 4:
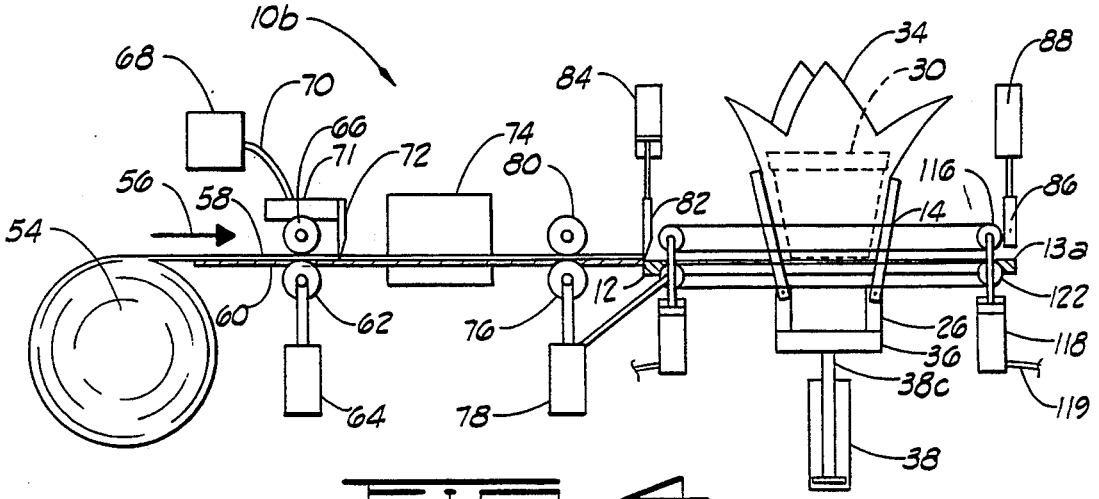
FIG. 4 is a side elevation, sectional view of a forming apparatus where the cover material is supplied by a continuous roll.
Figure 5:
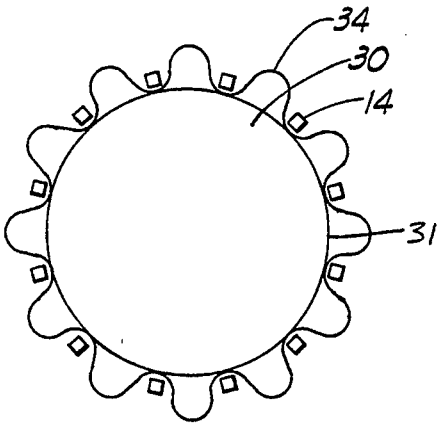
FIG. 5 is a top plan sectional view showing a set of forming members pressing a sheet of material against a mold or pot.

Shown in FIGS. 1, 2, 3 and 4 is a preferred embodiment of a cover forming apparatus 10 which is constructed in accordance with various embodiments of the present invention. The cover forming apparatus 10 is constructed and adapted to form a sheet of material 32 about an object 30 which may be a die, mold or pot to produce a flower pot or flower pot cover 34 (as shown in FIGS. 3 and 4).

As shown in a plan view in FIG. 1, the preferred embodiment of the cover forming apparatus 10 has a support surface 12 which serves as a support means with an upper side 13 upon which is laid a generally square sheet of material 32. The support surface 12 is incised with a plurality of rectangular openings 16 each with an inner edge **16*a*. All openings 16 intersect at the center of the support surface 12 to create a central opening 16*c*. Where two adjacent rectangular openings 16 intersect, the inner edge 16*a* of each rectangular opening meets to form an apical vertex 16*b* at the central opening 16*c*. The apical vertices 16*b*disposed around opening 16*c* provide support for the mold or pot 30 on the support surface 12. Each rectangular opening 16 houses one forming member 14. (In an alternative embodiment, each rectangular opening 16 may house more than one independently acting forming member 14**, for example as pairs or triplets of members).

Figure 1A:
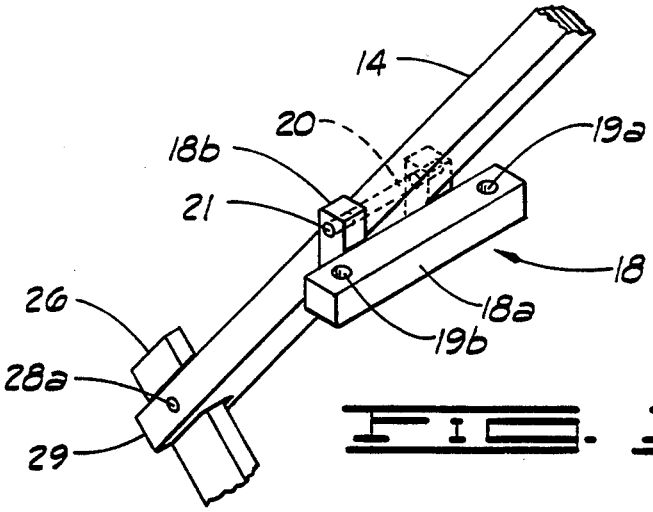
FIG. 1A is an oblique side elevational view of a forming member attached to a pivot mount.

In a preferred embodiment, each pivotable forming member, such as forming member 14, is supported within the apparatus 10 by a pivot assembly 18 as shown generically in FIGS. 1 and 1A which comprises a portion of a pivoting means for pivotally urging the forming members 14. In a preferred embodiment of the pivot assembly 18, the pivot assembly 18 is comprised of a pivot assembly cross arm **18*a* and a pivot assembly forming member 18*b*. The forming member 14 is engaged in a pivoting manner to the forming member mount 18*b* by a pivot assembly forming member mount pin 20 which extends through holes 21 in the forming member mount 18*b* and through the forming member 14. The pivot assembly cross arm 18*a* is slidably engaged to a pair of pivot assembly slots 22*a* and 22*b* which flank and are parallel to each rectangular opening 16. The cross arm 18*a* is engaged to slots 22*a* and 22*b* with pivot assembly cross arm couplers 24*a* and 24*b*, respectively, which extend through holes 19*a* and 19*b*, respectively, in the cross arm 18*a***.

The cross arm couplers **24*a* and 24*b* may be of any variety of pins, screws, clamps, bolts, or other connectors which can be tightened, then loosened and moved, then tightened again to allow the pivot assembly 18 to be repositioned along slots 22*a* and 22*b* so as to realign the forming member 14 within the rectangular opening 16 either closer to or further away from the central opening 16*c* of the support surface 12. This forming member 14 repositioning capability allows the cover forming apparatus 10** to be adapted to die, mold or pot objects having a variety of sizes, diameters and shapes some of which may even be asymmetric or irregularly shaped.

Each forming member 14 has an end 29 proximate to the central opening **16*c* which contains a clevis 28 through which a connecting rod 26 (or connecting spring 27 as shown in FIG. 3) is attached with a clevis pin 28*a* as shown in FIG. 1A. As shown in FIGS. 2, 3 and 4, the connecting rods 26 are attached to a connecting rod head 36 which is mounted on a piston element 38*c* which is reciprocatingly disposed within a hydraulic cylinder 38. The hydraulic cylinder is connected to an air supply (not shown) via air lines 38*a* and 38*b***.

The forming members 14 are shown in the fully retracted or storage position in FIG. 2 wherein the forming members 14 rest fully within the rectangular openings 16 and are more or less parallel to the support surface 12. The retracted or storage position is attained when the cylinder piston **38*c* projects upward in direction 51*a* causing the connecting rods 26 to slant inward and the forming members 14 to move downward in direction 52**.

In order for the sheet of material 32 to be brought into a contacting or forming position with the pot or mold 30, as indicated in FIG. 3, the forming members 14 must be projected into an extended position, again as shown in FIG. 3. The extended or forming position of FIG. 3 is attained when the cylinder piston **38*c* projects downward in direction 51*b* causing the connecting rods 26 (or springs 27) to pull downward on the forming members 14 at the point of the clevis connection 28*a*. This force results in the forming members 14 moving in direction 53 toward the mold or pot 30 and pushing the sheet of material 32 up so that it engages the outer surface 31 of the pot or mold 30**.

The present invention is contemplated such that the pot or cover 34 formed when the sheet of material 32 is pressed into contact with the mold or pot 30 may either form a readily separable and independent pot or cover 34 or may form a cover 34 which is connected more or less permanently to the pot 30.

The material which comprises the sheet of material 32 is preferably selected from the group of materials consisting of: man-made organic polymer films; fibers or fabric (woven or non-woven, synthetic or natural); metallic and non-metallic foils; paper (coated or uncoated, treated or untreated); cellulose (including cellophane); leather; burlap; "dead-fold" or semi-rigid sheet materials including, but not limited to, "dead-fold" plastic sheets, wire laminated flexible sheet material, waxed sheet material, starched or sugared sheet material; and laminations or combinations thereof.

The sheet of material 32 used with the forming apparatus 10 may employ materials having adhesives or cohesives on both sides of the sheet 32, an adhesive on one side and a cohesive on the other side or a cohesive or adhesive on only one side of the sheet 32 with no adhesive or cohesive on the other side of the sheet 32. The sheet 32 may be a heat sealable material for being sealed with heated forming men%hers 14 or other heated devices. The sheet 32 may be a welded film for being welded with heat or welded sonically or with a vibratory welding means.

In one embodiment of the invention the sheet of material 32 is formable into a flower pot or flower pot cover shape 34 which is substantially settable in that it has sufficient strength and rigidity to stand upright on its own. In this embodiment, the pot or cover 34 thus formed is removable from the forming die, mold or pot 30 and generally retains the shape so formed. Furthermore, in this embodiment the plurality of overlapping folds formed during the making of the cover 34 are substantially permanently connected by contacting surfaces which cohere to each other during the forming process.

The sheet of material 32 may require a coating of a cohesive to cause overlapping folds to be sufficiently connected to make the flower pot object 34 substantially settable and shape retaining. In one such embodiment, one side of the sheet of material 32 is coated with a pressure sensitive cohesive material such that when the forming members 14 of the forming apparatus 10 press the sheet of material 32 against the outer surface 31 of the pot or mold 30, the cohesive material causes the contacting surfaces of the overlapping folds to bond or connect to each other resulting in substantially permanent connections among the folds without an adhesive connection between the sheet of material 32 and the pot or mold 30. The formed pot or cover 34 can then be removed from the pot or mold 30.

In another embodiment of a pot or cover 34 removable from the forming die or pot 30, the sheet of material 32 may be coated on one side with a heat sensitive cohesive material such that when the forming members 14 of the forming apparatus 10 (the forming members having been heated to a sufficient temperature) press the sheet of material 32 against the outer surface 31 of the pot or mold 30, the heated forming members 14 activate the cohesive and cause the contacting surfaces of the overlapping folds of the sheet of material 32 to bond or connect to each other resulting in substantially permanent connections among the folds without an adhesive connection between the sheet of material and the pot or mold 30. The formed pot or cover 34 can then be removed from the pot or mold 30.

In another embodiment of a pot or cover 34 removable from the mold or pot 30, the sheet of material 32 itself may comprise a material such as an organic polymer film which is heat sensitive such that when the forming members 14 of the forming apparatus 10 (the forming members 14 having been heated to a sufficient temperature by a heating source) press the sheet of material 32 against the outer surface 31 of the pot or mold 30, the heated forming members 14 cause the contacting surfaces of the overlapping folds of the sheet of material 32 to seal to one another thereby substantially permanently bonding the folds together.

As previously mentioned, it is also contemplated that the present invention will form flower pot covers 34 having contacting surfaces which are more or less permanently connected by adhesives, cohesives or other securing means to outer surface 31 of the pot 30. In one series of embodiments portions of the sheet of material 32 are connected to the pot 30 with various adhesives or cohesives which coat either the sheet 32 or pot 30 or both the sheet 32 and pot 30. In another series of embodiments of the present invention described herein, portions of the sheet of material 32 are connected to the pot 30 with physical elements such as the barbs 92 shown on FIGS. 6 and 7 or a plurality of friction pinches 98 shown on FIG. 8.

In one embodiment of a pot connecting cover 34, at least one side of the sheet of material 32 is coated with a pressure sensitive adhesive of a type adapted to adhesively connect portions of the sheet of material 32 to the pot 30 when such portion of the sheet of material 32 are brought into contact with the pot by the forming members 14 under sufficient pressure to cause the adhesive connection at room temperature. In another embodiment the pressure sensitive adhesive is applied to portions of the outer surface 31 of the flower pot 30 wherein when the sheet of material 32 is brought into contact with the pot 34 by the forming members 14 under sufficient pressure, the portions of the sheet of material 32 which contact the areas of the pot 30 coated with adhesive become adhesively connected to the pot 30.

In an alternate embodiment, portions of the outer surface 31 of the forming pot 30 are coated with a pressure sensitive cohesive material. When a sheet of material 32 having at least one cohesively coated surface is oppressed with sufficient pressure by the forming apparatus 10 to the cohesively coated outer surface 31 of the flower pot 30, the cohesively coated portions of the sheet of material 32 are caused to bond with the cohesively coated portions of the flower pot 30.

In a similar embodiment, portions of the outer surface 31 of the forming pot 30 are coated with a heat sensitive cohesive material. A sheet of material 32 having at least one cohesively coated surface is appressed to the outer surface 31 of the flower pot 32 by forming members 14 of the forming apparatus 10 which have been heated to a temperature sufficiently elevated to cause the activation of the heat sensitive cohesive whereby portions of the sheet of material 32 are caused to be connected to the outer surface 31 of the pot 30.

It will be understood by the person of average skill in the art that various kinds of commercially available cohesives and adhesives may be used. A cohesive is defined as a material which tends to bond only to itself, that is, when a cohesive is applied to the surface of an object, will only bond to a surface coated with a similar or identical cohesive material. An adhesive is a material capable of causing binding or sticking to dissimilar surfaces, either uncoated, or similarly coated with the adhesive. The adhesive or cohesive used may be of any of a number of commercially available heat-sensitive or pressure-sensitive cohesives or adhesives including heat sensitive or pressure sensitive lacquers. The adhesive or cohesive material may have been applied to the sheet of material 32 so as to make it ready to use or it may be applied by a roller 66 (see FIG. 4), a brush, sprayer or the like, immediately prior to its use in the cover forming process as shown in FIG. 4.

Figure 6:
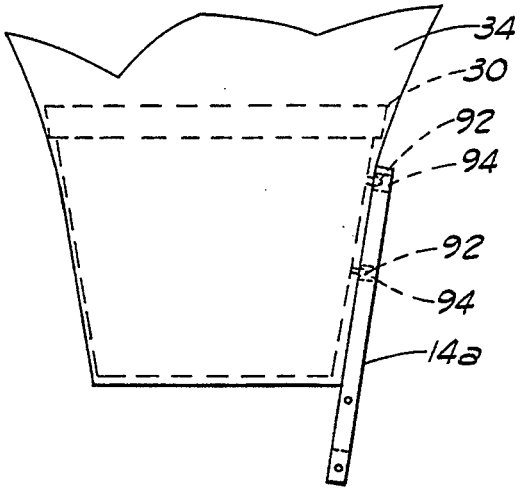
FIG. 6 is a side elevational, sectional view showing a forming member pressing a cover against a barbed pot.

The present invention contemplates methods other than adhesives and cohesives for the attachment of a sheet of material 32 to a pot 30. These methods involve a plurality of securing means which are attached to the outer surface 31 of the flower pot 30. For example, in one embodiment, the securing means may be pointed barbs 92 which are attached to the outer surface 31 of the flower pot 30 and which extend pointing away from the surface of the flower pot 30. Then the sheet of material 32 is appressed against the outer surface 31 of the flower pot 30, the sheet engages the barbs 92, which causes the barbs 92 to puncture the sheet of material 32 causing the material 32 to be caught underneath the head of the barb 92 thereby fastening the sheet of material 32 to the flower pot 30 as shown in FIGS. 6 and 7.

The barbs 92 may be distributed randomly across the outer surface of the pot 30 or may be organized in a non-random pattern of rows, columns or diagonals, or the like. The forming members 14 of the forming apparatus 10 may be modified as shown in FIGS. 6 and 7 so as to more efficiently engage the barbs 92 on the outer surface 31 of the pot 30. In one example, the forming member **14*a* shown in FIG. 6 comprises at least one aperture 94 positioned so that the barb 92 is projected into the aperture 94 when the forming member 14*a* is appressed against the outer surface 31 of the barb-bearing pot 30**.

The aperture 94 may have the shape of a square, rectangle, or cylinder, or other appropriate shape and may protrude completely or only partially through the forming member **14*a*. As the barb 92 projects into the aperture 94 of the forming member 14*a*, the barb 92 punctures the sheet of material 32 causing a portion 32*a* of the material to be caught underneath the barb 92. When the forming member 14*a* is retracted away from the pot 30, the sheet of material 32 remains connected to the pot 30, having formed a cover 34 of the pot 30**.

Figure 7:
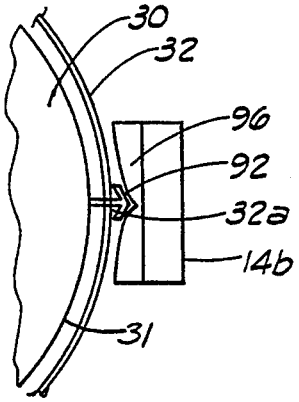
FIG. 7 is a top plan sectional view showing a forming member pressing a sheet of material against a barb.

In another example, the forming member **14*b* shown in FIG. 7 comprises an inner surface of a substantially flexible material 96 such as a springy but firm foam or rubber. This flexible material 96, when caused to press a portion of a sheet of material 32 against a barb or barbs 92, is sufficiently flexible that it pushes the material about the barb 92 thereby causing the barb 92 to puncture the sheet of material 32 so that a portion of the material 32*a* is caught below the head of the barb 92 thereby fastening the material 32 to the pot 30 forming a cover 34 around the pot 30. This type of forming member 14*b* with a flexible inner surface 96 is especially adapted to engaging barbs 92 which are randomly or otherwise positioned on the surface of the pot 30 in such a way that the barbs 92 would be misaligned with the apertures 94 of an aperture-bearing forming member 14*a***.

Figure 8:
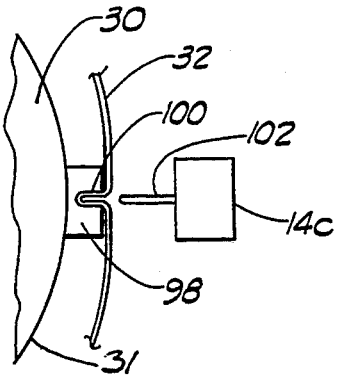
FIG. 8 is a top plan sectional view showing a friction pinch element and friction pinch forming member.

In another embodiment of the securing means which are attached to the outer surface 31 of the pot 30, the securing means may be a plurality of female friction pinch elements 98 as shown on FIG. 8. The female friction pinch elements 98 are distributed over the outer surface 31 of the pot 30 in some non-random fashion which allows at least one female friction pinch element 98 to be mated with at least one male friction pinch element 102 carried on a forming member **14*c* modified to be able to mesh with female friction pinch elements 98**.

As shown on FIG. 8, when a male friction pinch element 102 presses a sheet of material 32 against a female friction pinch element 98 and causes a portion 100 of the sheet of material 32 to be inserted into the female friction pinch element 98, the inserted material 100 acts to fasten the sheet of material 32 to the outer surface 31 of the flower pot 30. As indicated, the forming member **14*c* with at least one male friction pinch element 102 comprises another specialized embodiment of forming member 14**.

Figure 9:
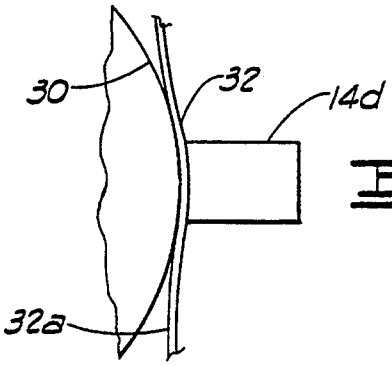
FIG. 9 is a top plan sectional view showing a heat-sealing forming member pressing a heat-sensitive sheet against a pot cover.

Another forming member modification is the forming member **14*d* as shown in FIG. 9 which represents a forming member 14*d* capable of being heated to a temperature sufficiently elevated to cause the heat activation of sheets of material 32 coated with heat-sensitive adhesives or cohesives or sheets of material 32** composed of organic polymer films which are themselves heat sealable and bondable.

As noted previously, the present invention contemplates embodiments in which the sheet of material 32 can either be permanently affixed to the flower pot 30 as indicated by FIGS. 5, 6, 7, 8 and 9 or can be formed in such a way as to leave them free from the mold 30 around which they were formed. In one embodiment shown in FIG. 2, a manufacturing process is envisioned in which the cover forming apparatus 10 would include a positioning assembly 39 for positioning the mold 30 on the forming surface 13 and for retracting the mold 30 into a storage position above and away from the forming apparatus surface 12 indicated at 50.

In the positioning assembly 39, as shown in FIG. 2, a die or mold 30 is connected to a piston or rod **40*a* which is reciprocatingly disposed in a hydraulic cylinder 40. The die or mold 30 may be generally frusto-conically shaped with the narrower end 30*a* positioned distally to the cylinder 40 and the wider end 30*b* positioned proximally to the cylinder 40. The hydraulic cylinder 40 is adapted and positioned to move the die or mold 30 in a downward position 41*b* to a forming position and to move the die or mold 30 in an upward position 41*a* to a storage position. The hydraulic cylinder 40 is connected to a support assembly 42 by a pivoting beam 44**.

The support assembly 42, the beam 44, and the hydraulic cylinder 40 together support the die or mold 30 a distance above the support surface 12. An air supply (not shown) is supplied via air lines **108*a* and 108*b* to the hydraulic cylinder 40 to control the movement of the mold 30 in an upward direction 41*a* and a downward direction 41*b*. In the forming process the die or mold 30 is disposed in a downward direction 41*b* until it comes to rest on the sheet of material 32 which is disposed between the upper side 13 of the support surface 12 and the die or mold 30**.

After the pot or cover 34 has been formed around the die or mold 30 in the forming member extending process described previously, the die or mold 30 is retracted by cylinder rod **40*a* in an upward position 41*a*** whereby the newly formed pot or cover 34 is removed from the die or mold 30. The forming apparatus 10 is returned to the retracted or storage position in the manner described previously. Another sheet of material 32 is placed on the upper side 13 of the support surface 12 in preparation for another pot or cover forming production cycle.

The die or mold 30 and the cylinder 40 can also be displaced from its storage position directly over the support surface 12 to an offset position as shown at 50 in FIG. 2. A secondary hydraulic cylinder 46 is attached by a reciprocatingly disposed rod to beam 44 which is pivotally attached to the cylinder 40. The secondary hydraulic cylinder 46 is attached to the support assembly 42 by a support armature 48. The hydraulic cylinder is connected to an air supply (not shown) which is connected to a control valve (not shown) which controls the operation of the hydraulic cylinder 46.

In the position shown in FIG. 2, cylinder 46 is retracted, causing the primary cylinder 40 to be positioned directly above the forming apparatus 10. The cylinder rod in cylinder 46 can be extended to cause the beam 44 to be pivotally moved to the position 50 whereby beam 44 carries cylinder 40 and mold 30 in a direction which causes the cylinder 40 and mold 30 to be in a position offset from the support surface 12. The positioning assembly 39 may also include a cover unloading assembly (not shown) adapted to remove the formed covers from the mold 30.

It will be appreciated that in an alternative embodiment, the cover forming apparatus 10 can operate manually without benefit of the positioning assembly 39 wherein a pot 30 is placed manually and the forming members 14 are caused to form a cover 34 about the pot 30.

It is envisioned that when the present invention is designed in an alternative embodiment as part of a manufacturing process, it is possible that to increase the efficiency of the process the sheet of material 32 may be provided from a roll of material 54 as shown in FIG. 4 wherein the roll of material 54 is adapted to roll in a direction 56 and thereby feed the material as a sheet 58 over an extension 60 of the support surface 12 into a system of rollers 62 and 66 as part of the operation of system **10*b* in FIG. 4. The roll of film 54 is supported generally near surface 60. The material 58 on the roll 54 is passed through a pair of rollers 62 and 66 where at least one of the rollers, shown as 62 in FIG. 4, is drivingly connected to a motor 64 or other such drive means which is adapted to drivingly rotate the roller 62 connected thereto for drivingly moving the sheet of material 58 between the rollers 62 and 66 thereby unrolling a portion of the material from the roll of material 54 and passing a portion of the sheet of material 58 in the direction 56 generally onto a portion of the upper side of the surface 60 in preparation for its final positioning on surface 12 above the forming apparatus of 10*b***.

The system **10*b* is shown to include a cutting assembly 84 and 82 which includes a knife 82 having a portion thereof connected to a rod reciprocatingly disposed within a hydraulic cylinder 84 which is connected to an air supply and control mechanism (not shown) and is supported at a position above the support surface 12. The material 58 being unrolled from roll 54 and drivingly fed through rollers 62 and 66 is further directed over surface 60 and fed into rollers 76 and 80, one roller of which, and more particularly in this case roller 76, is drivingly connected to a driving means 78 which is adapted to drivingly rotate roller 76 and drivingly move sheet 58 in direction 56 toward the support surface 12**.

The forming apparatus **10*b* may also be equipped with a conveyor belt assembly 115 (see FIGS. 2, 3 and 4) which receives the sheet of material 58 for advancing the sheet of material 58 onto the support surface 12. The conveyor belt assembly comprises an upper conveyor belt 116 and a lower conveyor belt 122. The upper conveyor belt 116 is connected to a displacing means 118 which, in the preferred embodiment, lifts the upper conveyor belt 116 in a direction 126 whereby the sheet of material 58 is then released. The lower conveyor belt 122 is connected to a drive means 124. When the upper conveyor belt 116 is in a lowered operating, position (see FIG. 2) the drive means 124 drives both the lower conveyor belt 122 and the upper conveyor belt 116 for driving the sheet of material 58 disposed therebetween. The displacing means 118 may be a hydraulic or air cylinder which is activated by a fluid or air supply 119**, respectively.

The system **10*b* is equipped with a sensing device 86 which is adapted to sense the positioning of the sheet of material 58 on the support surface 12. The conveyor assembly 115 drivingly moves the material 58 onto the support surface 12 until sensing device 86 senses the presence of the material 58 at the edge 13*a* of the support surface 12. The sensing device 86 activates a sensor relay means 88 which causes rollers 62 and 76 and conveyor assembly 115 to be stopped, which in turn stops further movement of the sheet of material 58 on the surfaces 58 or 12 of apparatus 10*b*. The relay means 88 also directs the cutting assembly cylinder 84 to extend the blade 82 such that a portion of the roll of material 58 is severed thereby leaving a generally square-shaped sheet of material 32 operatively disposed onto the support surface 12 above the forming apparatus of 10*b* in preparation for the next production cycle. After the sheet of material 32 has been cut from the roll of material 54, the hydraulic cylinder 84 returns the blade 82** to the storage position.

The material on the roll of material 54 may be previously coated with a cohesive or adhesive material or, in the embodiment shown in FIG. 4, the adhesive or cohesive may be applied just prior to being moved into position on surface 12 over the forming apparatus of **10*b*. In such an embodiment, the adhesive or cohesive material is stored in a reservoir 68 and fed via a line 70 into an applicator assembly 71 which includes an applicator roller 66 and a doctor blade 72. Adhesive or cohesive is applied to the sheet of material 58 as it rolls underneath the roller 66. The doctor blade 72 is located down line from the roller 66 and is positioned at some height above the sheet of material 58 where it serves to remove excess amounts of adhesive or cohesive by scraping the excess away as the sheet of material 58 is driven in direction 56 toward the forming apparatus of system 10*b*. A drying oven 74 is located down-line from the applicator assembly 71 and serves to dry the adhesive or cohesive prior to its movement through rollers 76 and 80**.

Figure 10A:
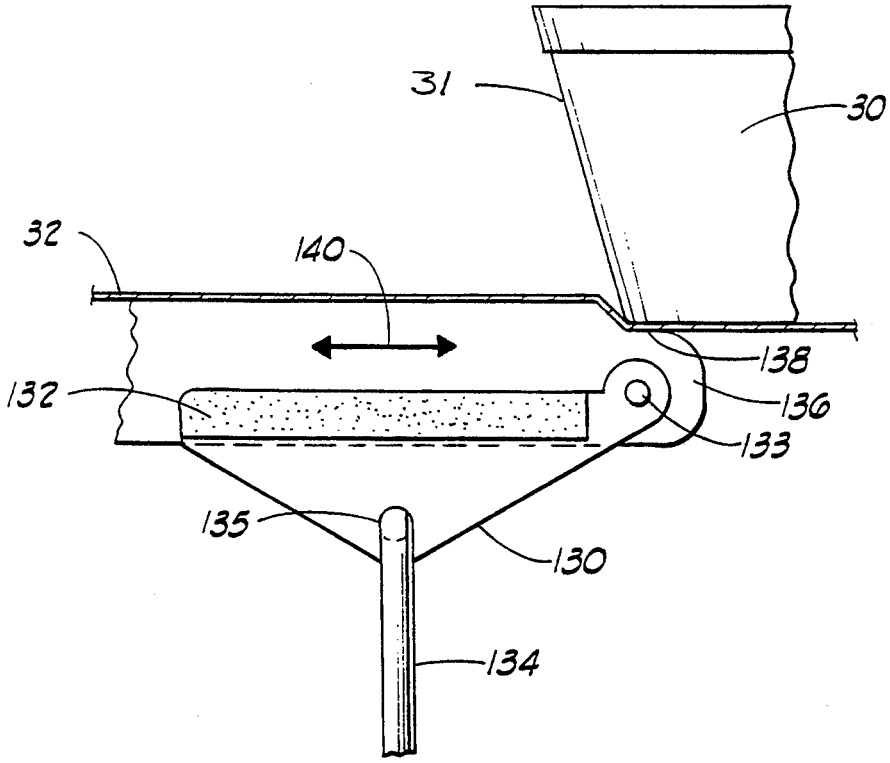
FIG. 10A is a side view of an alternative forming member embodiment showing the forming member in a storage position.
Figure 10B:
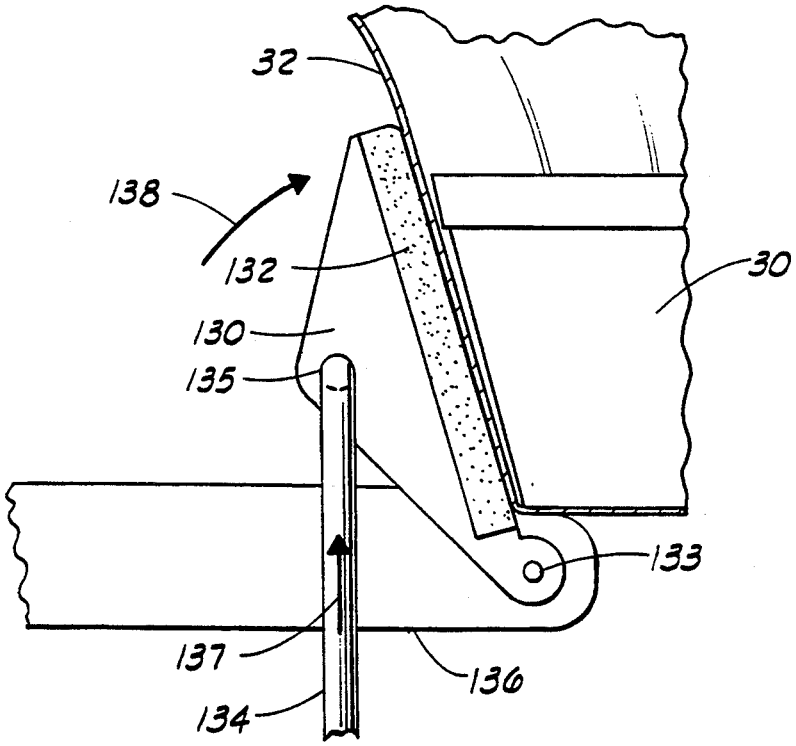
FIG. 10B is a side view of the embodiment in FIG. 10A in an extended position.

Other embodiments of the pivoting forming members and of the pivot assemblies which comprise the pivoting means can be envisioned as illustrated in FIGS. 10A through 14B. The FIGS. 10A–14B show only one or two forming members but it will be understood that each embodiment is comprised of a plurality of forming members. In FIG. 10A a pot 30 is shown disposed over a sheet of material 32. The forming member 130 has a forming surface 132 which may be comprised for example, of a foam material. The pot 30 rests upon the recessed portion 138 of a support surface 136. The forming member 130 is pivotally attached at pivot position 133 to the support surface 136. The forming member 130 is attached to a connecting rod 134 which is connected to a connecting rod head (not shown). The rod 134 is pivotally attached at pivot point 135 of forming member 130. As indicated in FIG. 10B, when the rod 134 is moved in a direction 137, the forming member 130 is forced in a direction 138 wherein the sheet 32 is pressed against the outer surface 31 of the pot 30 by the forming surface 132. The support surface 136 can be moved in direction 140 to be adjusted for differing sizes of the pot 30.

Figure 11A:
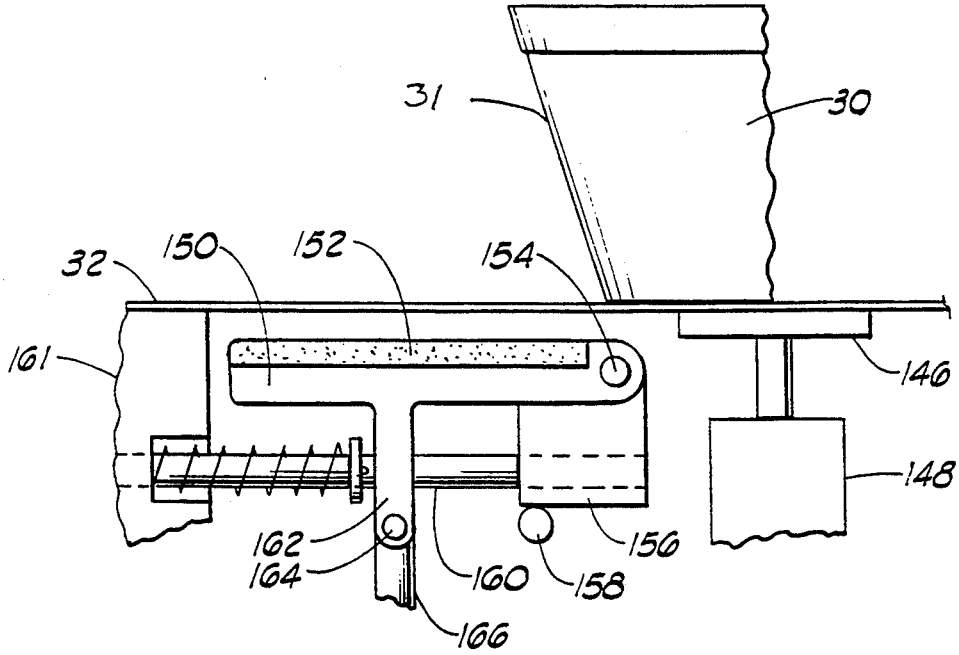
FIG. 11A is a side view of an alternative embodiment showing a forming member in a storage position.
Figure 11B:
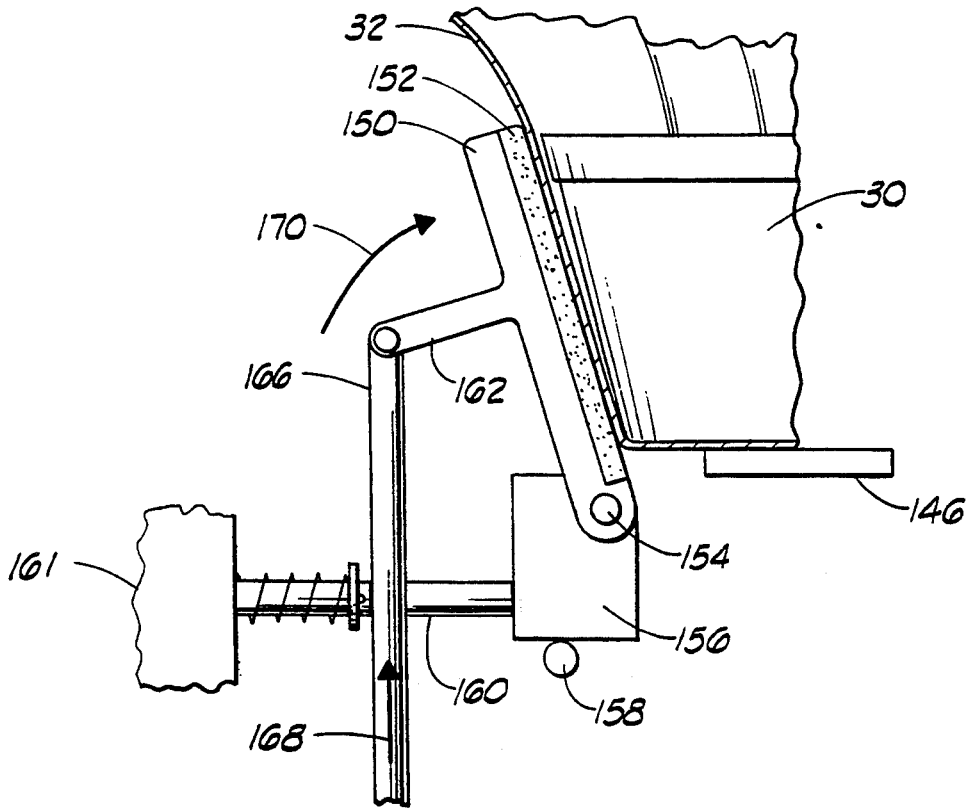
FIG. 11B is a side view of the alternative embodiment of FIG. 11A with the forming member in an extended position.

Another embodiment is illustrated in FIGS. 11A and 11B. The forming member 150 has a forming surface 152. The forming member 150 is attached at a pivot point 154 to a pivoting head 156. The pivoting head 156 is connected to a positioning rod 160. The positioning rod 160 is reciprocatingly attached to a support surface 161. Pivoting head 156 rests upon and is rollingly engaged with a roller 158. Forming member 150 has an extension arm 162 which is connected at a pivoting point 164 to a connecting rod 166. The pot 30 is supported by a supporting surface 146 which is reciprocatingly attached to a supporting cylinder 148. When the connecting rod 166, attached to a connecting rod head (not shown) is pushed upward in a direction 168 (see FIG. 11B) the forming member 150 is moved into a direction 170 wherein the sheet of material 32 is pressed by the forming surface 152 against the outer surface 31 of the pot 30. The position of the forming member 150 and the pivoting head 156 can be modified by changing the position of the positioning rod 160 in relation to the support surface 161 as indicated in FIG. 11B.

Figure 12A:
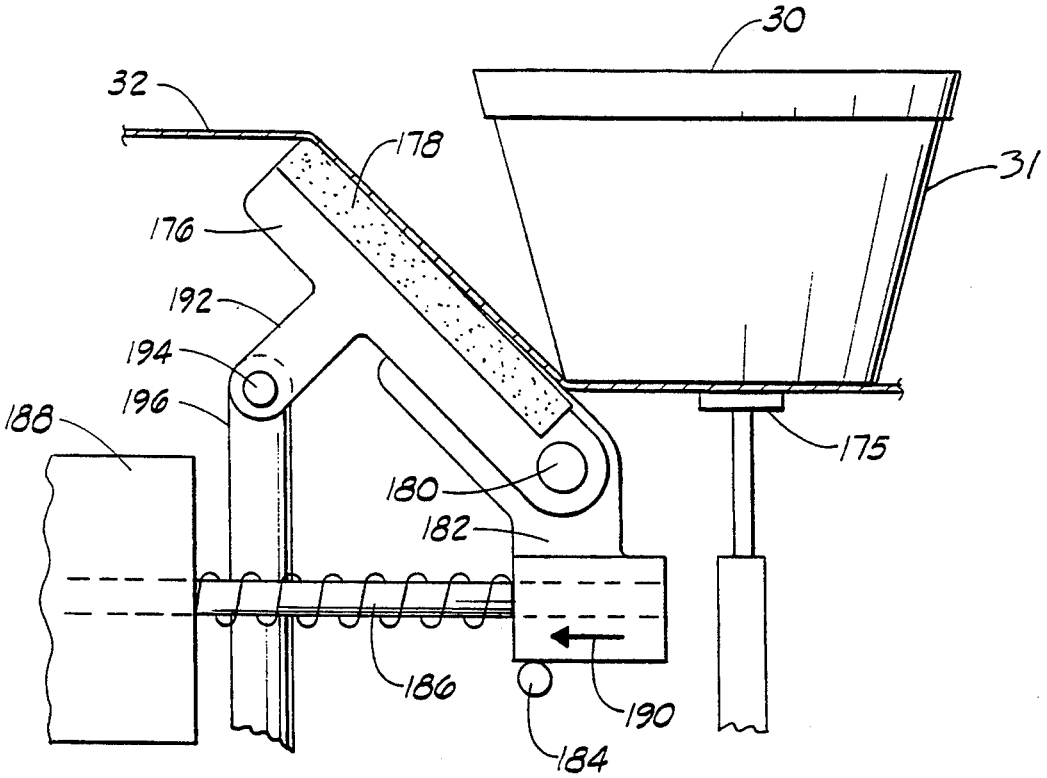
FIG. 12A is a side view of an alternative embodiment of a forming member assembly showing a forming member in a partial extended position.
Figure 12B:
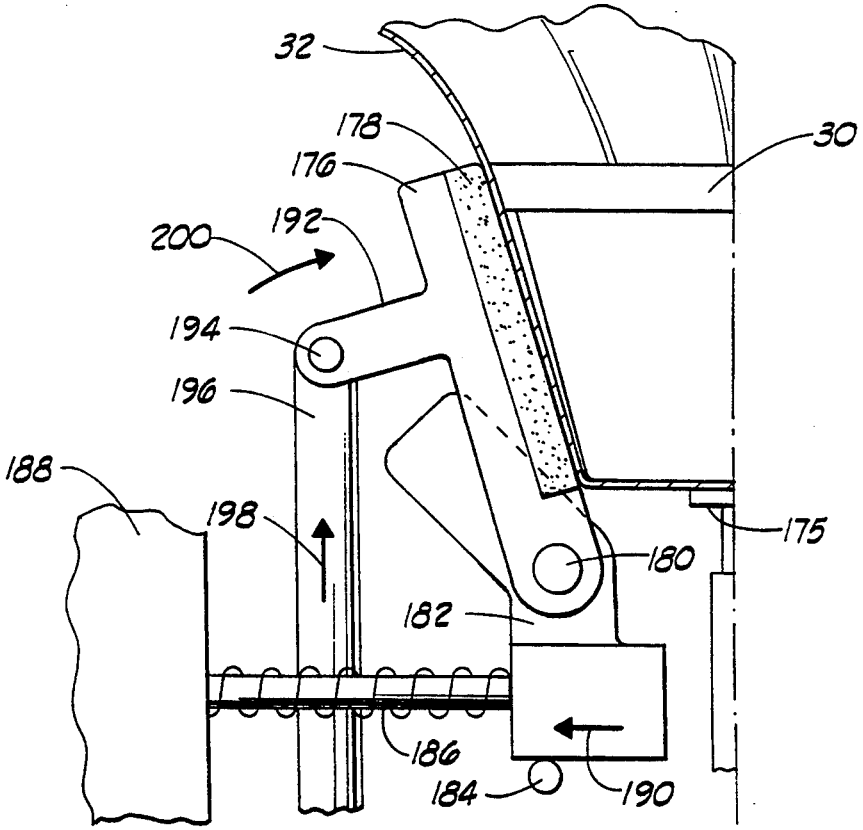
FIG. 12B is the embodiment of 12A with the forming member in the full extended position.

FIGS. 12A and 12B illustrate an embodiment in which a pot 30 and a sheet of material 32 are supported upon a support surface 175. A forming member 176 having a forming surface 178 is attached with a pivot attachment 180 to a pivoting head 182. A roller 184 supports and rollingly engages the pivoting head 182. The positioning rod 186 is attached to the one end to the pivoting head 182 and at the other end to a bracing structure 188 for the purpose of positioning the pivoting head 182 and moving it in a direction 190 to accommodate various sizes of pots 30. The forming member 176 has an extension arm 192 which is connected at a pivot point 194 to a connecting rod 196 for extending the forming member 176 into a forming position (FIG. 12B). When the connecting rod 196 is extended in a direction 198 as indicated in FIG. 12B the forming member 176 is extended in direction 200 for causing the forming member 176 to move into an extended forming position. Connecting rod 196 is connected to a connecting rod head (not shown) which is actuated by a driving means (not shown) which can be motor driven or manually driven, e.g. by a foot pedal.

Figure 13A:
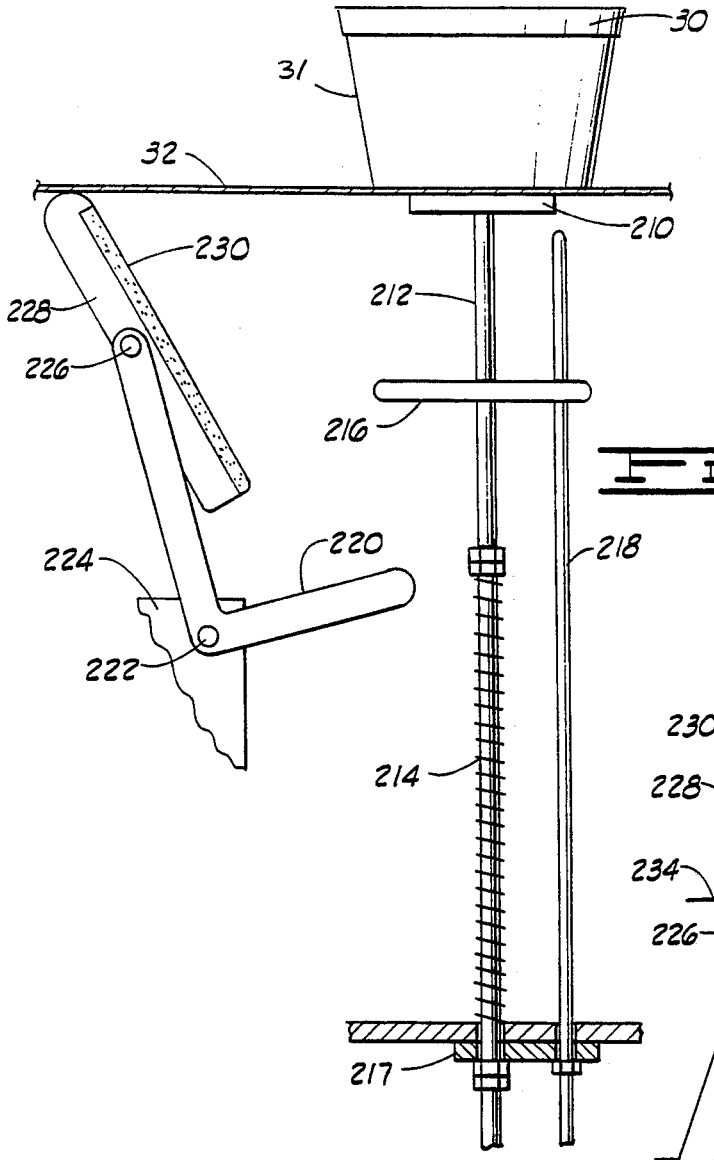
FIG. 13A is a side view of an alternative embodiment of a forming assembly showing a forming member in a storage position.
Figure 13B:
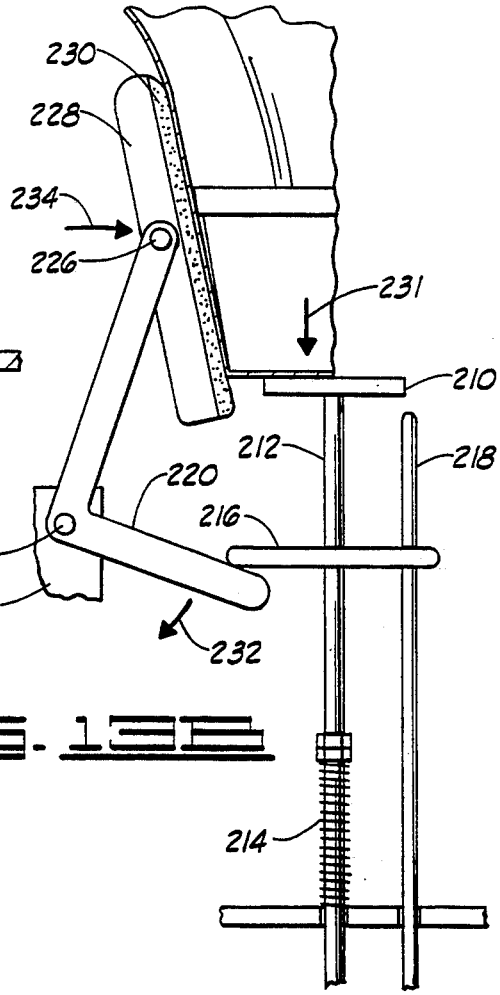
FIG. 13B is a side view of the embodiment of FIG. 13A in the fully extended position.

An alternative embodiment is illustrated in FIGS. **13*a* and 13*b*. A pot 30 and a sheet of material 32 are supported on a support surface 210. The support surface 210 is supported by a support rod 212 having an extension spring 214 for biasing the support rod 212 in an extended position (FIG. 13A). Support rod 212 has a stop plate 217 for stopping the upward motion of the rod 212. A strike plate 216 is attached to the support rod 212 for the purpose of striking against a pivot armature 220 of a forming member 228. A secondary support rod 218 serves to maintain alignment of the strike plate 216. The pivot armature 220 has a pivot connection 222 for pivotally connecting to a bracing structure 224. The other end of the pivot armature 220 has a second pivot connection 226 for pivotally connecting to the forming member 228. The forming member 228 has a forming surface 230. When the pot 30 is drawn or pushed downward in direction 231 (FIG. 13B) the support rod 212 is disposed in a downward direction 231 wherein the strike plate 216 engages pivot armature 220 and pushes the pivot armature 220 downward in a direction 232. Forming member 228 is thereby moved in direction 234, wherein the forming surface 230 of the forming member 228 forces the sheet of material 32 against the outer surface of the pot 30 as indicated in FIG. 13B**.

Figure 14A:
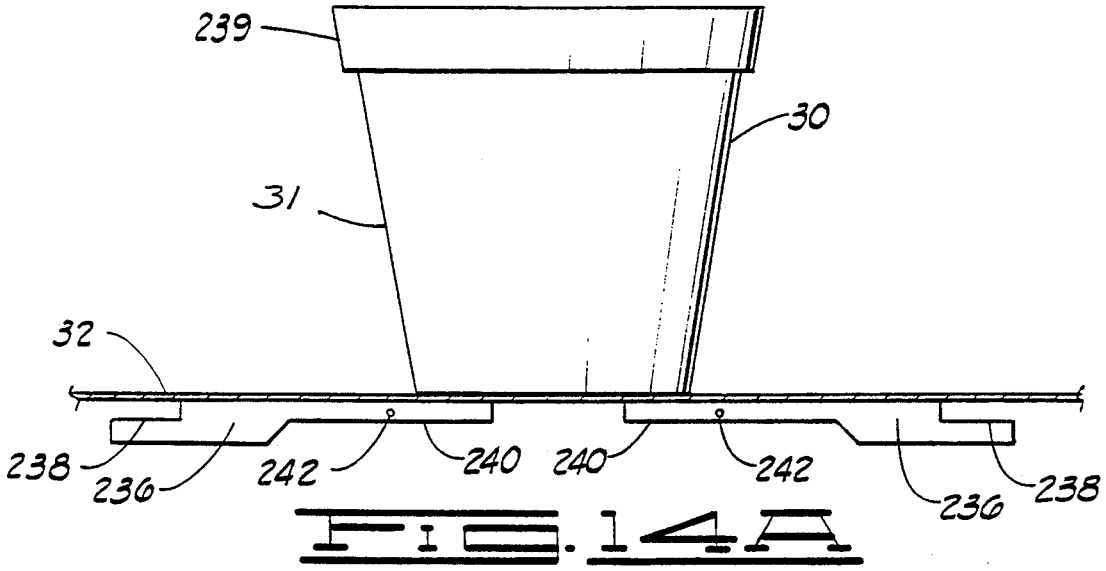
FIG. 14A is further alternative embodiment of a forming member assembly showing forming members in a storage position.
Figure 14B:
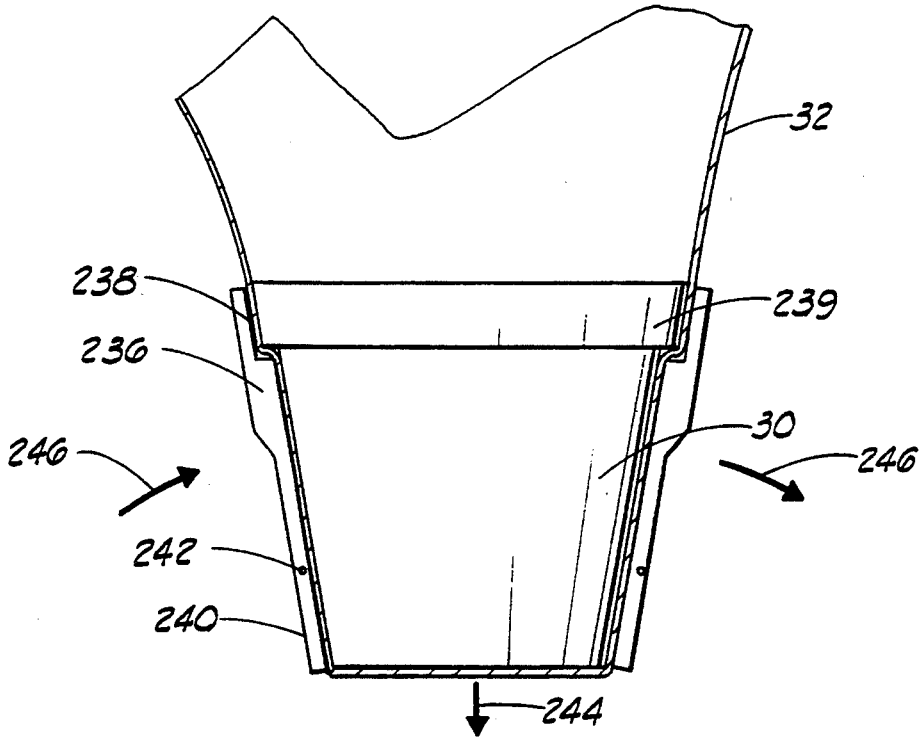
FIG. 14B is a side view of the alternative embodiment of FIG. 14A wherein the forming members are in the fully extended position.

A further embodiment is shown in FIGS. 14A and 14B. The pot 30 having a rim 239 is supported by a support end 240 of a forming member of 236. Forming member 236 has a recessed portion 238 adapted to receive the rim 239 of the pot 30. The forming member 236 is typically attached at pivot connection 242 to a forming member support head (not shown). As indicated in FIG. 14B when the pot 30 is pushed in a downward direction 244 the forming members 236 are caused to move in a direction 246 toward the pot wherein the sheet 32 is appressed by the forming members 236 against the pot. When the pot 30 is released, the forming members 236 are carried by gravity into the original storage position indicated in FIG. 14A.

It will be understood that the forming surfaces 132, 152, 178, 230, and the forming surface of 236 will, as indicated, for embodiments be comprised variously of such materials as foam or other soft or pliable plastic or other soft materials. Additionally the forming men,hers 14, 130, 150, 176, 228 and 236 may be variously modified with heating elements, airblast jets, and sonic means, for the purpose of causing formation of the sheet of material to adhere or cohere to form a pot cover 34.

Figure 15A:
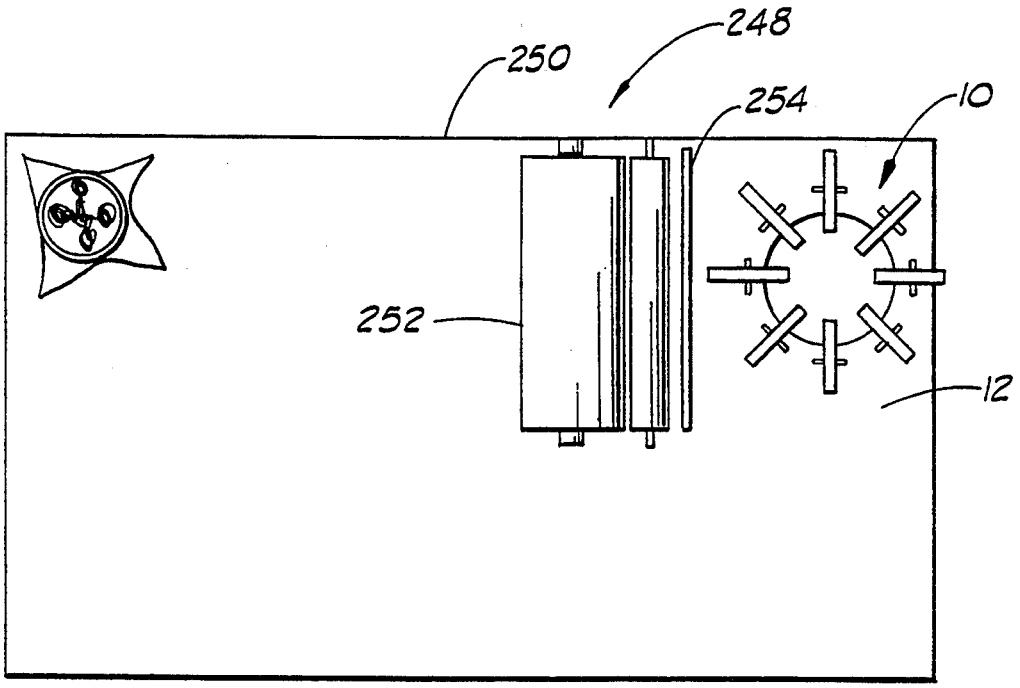
FIG. 15A is a top plan view of a mobile cover forming apparatus.
Figure 15B:
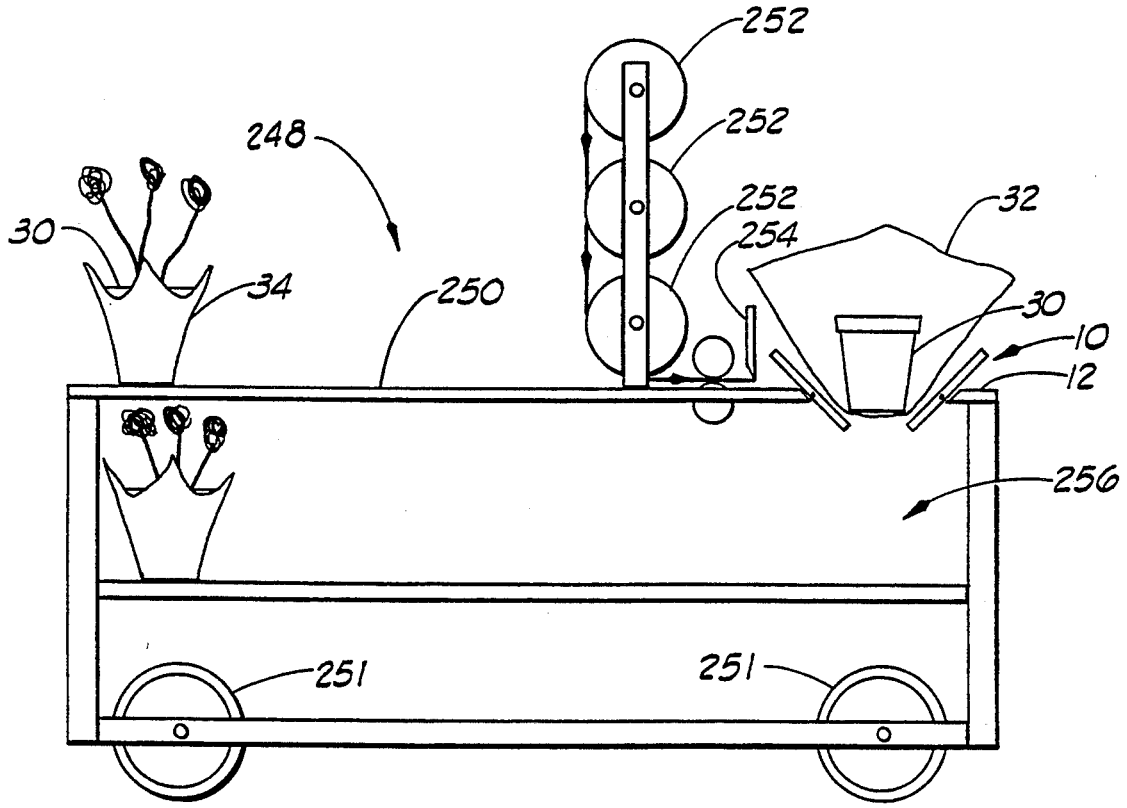
FIG. 15B is a side view of the mobile cover forming apparatus of FIG. 15A.
Figure 15:
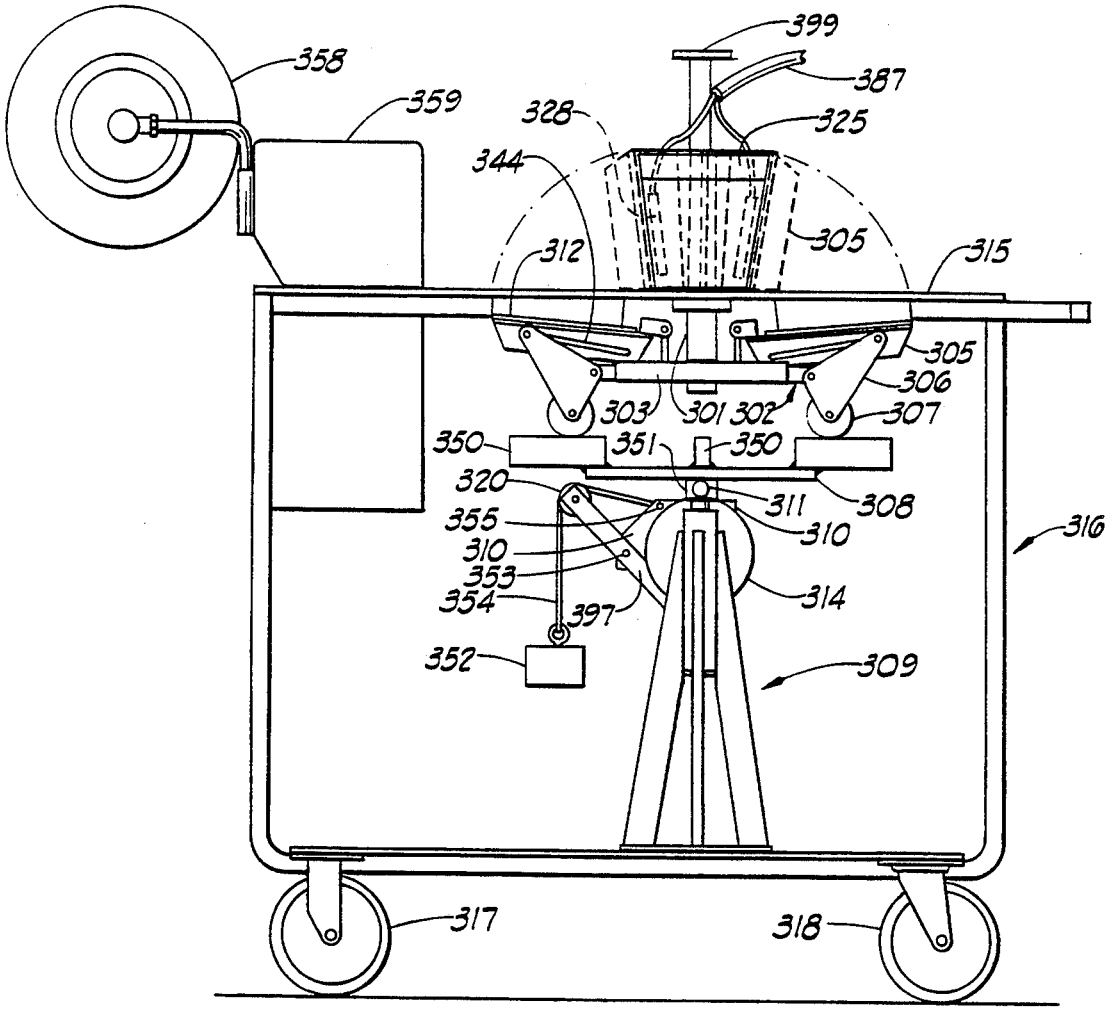

In an alternative embodiment, the cover forming apparatus 10 installed on a mobile cover forming apparatus 248 which is a portable platform 250 used for wrapping, storing, and transporting covered pots as shown in FIGS. 15A and 15B and having wheels 251 or other means for enabling the mobile platform to be moved from one location to another. The cover forming apparatus 10 of the mobile cover forming apparatus 248 can comprise all forming member embodiments described herein including the forming men,bets described in FIGS. 1, 1A, and 5–14B. The mobile apparatus 248 may be equipped with rolls of material 252 which can be fed to the support surface 12 of the forming apparatus 10 or sheets of material 32 may be fed individually as loose sheets (not shown) or pads of sheets (not shown). Sheets could be fed individually or more than one sheet could be placed on the support surface 12 for forming a cover having multiple layers (not shown). If the sheet 32 was fed from a continuous roll 252 the individual sheets 32 could be separated from the roll 252 using an air knife 254 or guillotine or by serrations formed in the roll of material 252. This mobile cover forming apparatus 248 could be moved to a given location in a greenhouse where a single pot 30 would be removed from a table, wrapped and stored in a storage area 256 on the cart wherein the cart mobile apparatus 248 could then be moved to another location in the greenhouse if so desired.

DESCRIPTION OF THE EMBODIMENTS OF FIGS. 16–26

Figure 27:
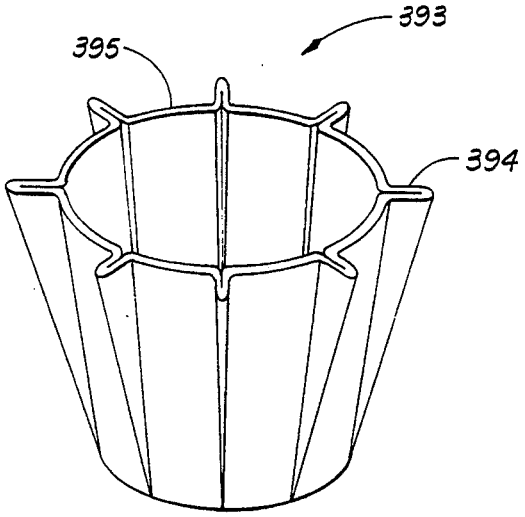
FIG. 27 is a perspective view of a formed flower pot or flower pot cover made using the apparatus shown in FIGS. 16–23.
Figure 28:
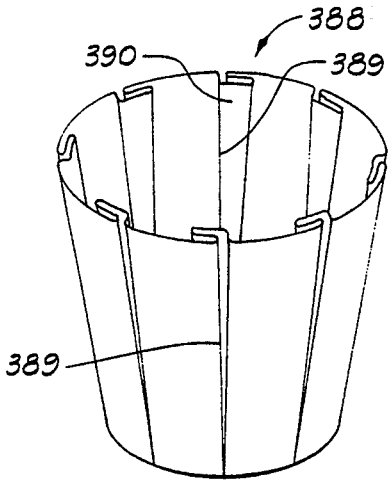
FIG. 28 is a perspective view of a formed flower pot or flower pot cover made using the apparatus shown in FIGS. 16–26, without a skirt portion.
Figure 29:
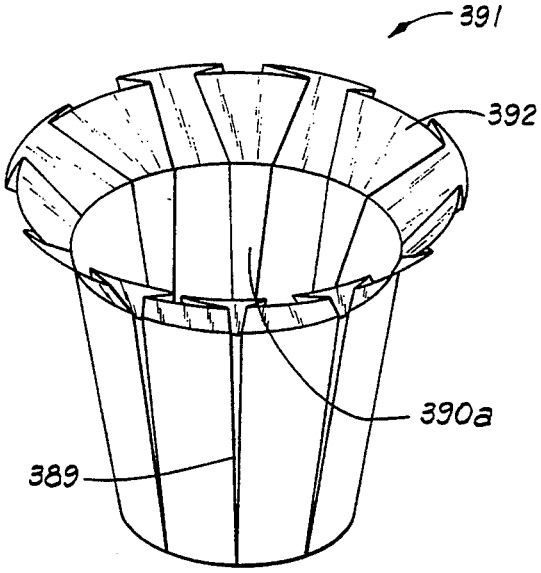
FIG. 29 is a perspective view of a formed flower pot or flower pot cover made using the apparatus shown in FIGS. 16–26, with a skirt portion.

FIGS. 16–26 represent yet further embodiments of the invention with which a flower pot or flower pot cover can be formed. FIGS. 27–29 depict examples of such formed flower pots or flower pot covers. Employing the concepts of the invention according to FIGS. 16–26 results in two basic body designs for the flower pot or flower pot cover, one with outwardly directed and uniformly spaced pleats, and the other with inwardly directed portions pressed into overlapping folds on the inside of the formed cover thereby avoiding overlapping folds on the outside of the cover. In the latter case, the folds are created in a more controlled fashion than the folds produced by the forming apparatus shown in FIGS. 1–15. In FIGS. 1–15, as the sheet of material is formed around a die mold or flower pot 325, the action of the forming members causes the sheet material to fold in a random pattern about the die mold or flower pot 325. In the arrangement of FIGS. 16–26, the folds are more predictable and more precisely defined, even uniformly spaced if desired, in the finished product.

The embodiment of the invention (yet to be described) that forms internal overlapping folds utilizes an arrangement referred to hereinafter as a gathering finger assembly, while the embodiment of the invention that produces the outwardly directed uniformly spaced pleats is substantially the same machine but without the gathering finger arrangement in place or with it in place but not operational. The first embodiment to be described will be that without the employment of a gathering finger arrangement.

In the discussion to follow, reference may be made to forming a flower pot or to forming a flower pot cover. The invention is equally suited to produce either, as desired, depending mainly upon the nature of the sheet material (e.g. strength, flexibility, thickness, resiliency, etc.) and whether the sheet material is formed about a reusable mold or formed about a flower pot that will become part of the finished product (covered flower pot). A cover could be formed about both a mold and a flower pot, of course. Accordingly, when either term "flower pot" or "flower pot cover" is used hereinafter, single or together, both are meant.

Figure 16:
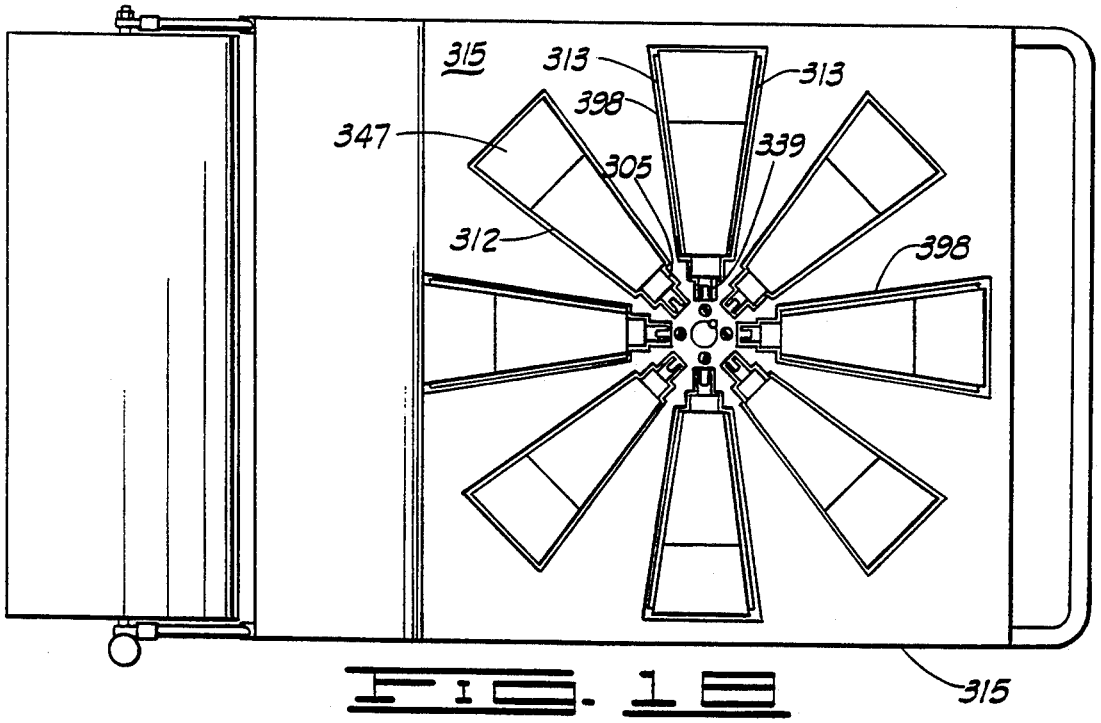
FIG. 16 is a side elevation view of an alternative form of the invention for forming a flower pot or flower pot cover, wherein some components have been removed so as not to obscure the view.

FIG. 16 shows a side elevation view of the cover forming apparatus illustrating several operational parts which will be described in more detail with reference to subsequent figures. In FIG. 16, a machine frame 316 is provided with a top plate 315 and may be transportable by the provision of a set of casters comprising rigid casters 317 and swivel casters 318. The mobile cover forming apparatus may also comprise a roll of material 358 dispensed through a sheet guide and support 359, the sheet material being disposable onto the surface of top plate 315. The sheet of material may be automatically cut as described in connection with the arrangement of FIG. 4 or may be perforated and separated from the remainder of the roll of the sheet material when in position and ready for use. In the latter case, the roll of material may consist of a continuous sheet with circular, partially punched out, cover sheets easily removable from the continuous sheet of material as each perforated sheet is separated from its surrounding web of material. The material from which a flower pot or flower pot cover is to be formed may also be supplied in a stack of precut sheets and manually or automatically dispensed to be disposed in position on the top plate 315. It will be appreciated that any geometrical configuration of the sheet of material and any manner of manually or automatically feeding sheets of material to the top plate support surface 315 can be used in carrying out the invention.

Referring to FIGS. 16–19, an assembly of forming members comprised of swing arms 305 are positioned below the top plate 315 and are pivotally mounted to an adjustment disc assembly 303 which is supported on top plate 315 by a center hub 301. Swing arms 305 pass through conforming slots 398 in top plate 315.

A pivot slide assembly 302 permits the swing arms 305 and their associated operational parts to be moved radially inwardly and outwardly to selected fixed positions, depending upon the size of the flower pot or mold to be used in forming a pot or cover. In the discussion to follow, an arrangement, although not size limited, will be described showing means for accommodating 4", 6", and 10" flower pots or covers.

At the ends of slide bars 333 making up pivot slide assembly 302, lever arms 306 are pivoted. Lever arms 306 also have connections to slots 344 in swing arms 305 and to the axles of lever wheels 307.

Figure 17:
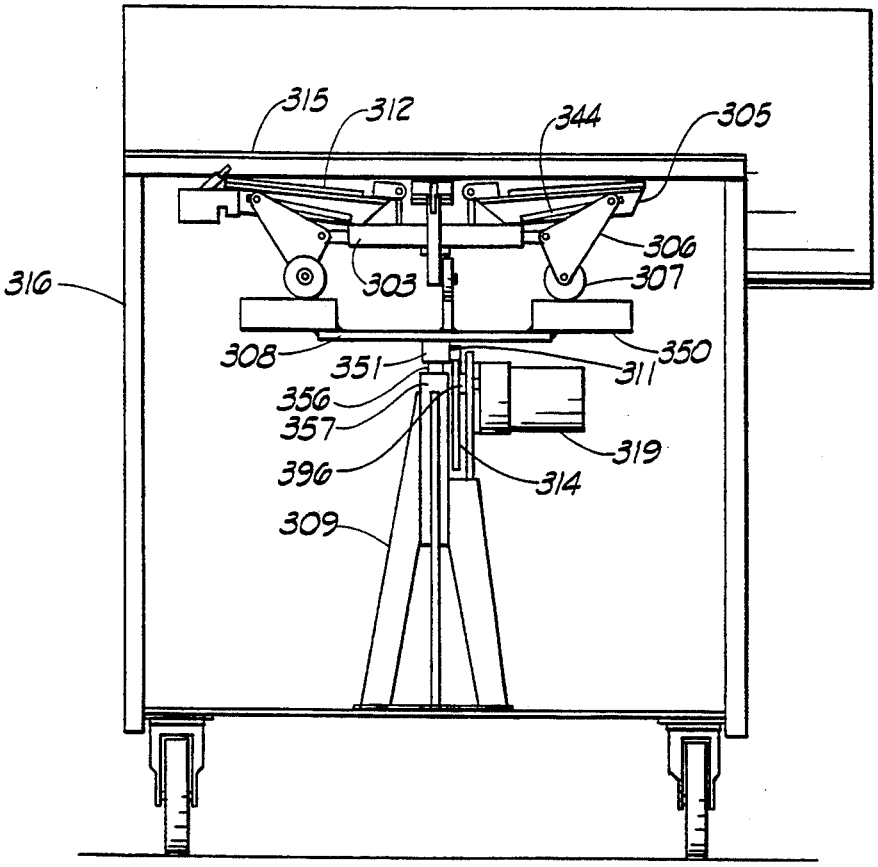
FIG. 17 is a front elevation view of the arrangement shown in FIG. 16.

Lever wheels 307 ride on the top surfaces of a corresponding number of wheel guides 350 welded to a rising plate 308. In FIGS. 16 and 17, only selected lever wheels and wheel guides are shown so as not to unduly complicate the drawing. In practice, eight of the wheel/guide assemblies are used.

Also welded to rising plate 308 is a cam follower mounting block 351 upon which is journalled a cam follower 311 functioning to follow the peripheral surface of rising plate cam 314 rotating eccentrically about eccentric pivot shaft 396 by means of a geared motor 319 mounted on a motor mount 310.

Motor mount 310 is movable so as to lower rising plate cam 314 in the event that the mechanism becomes jammed or the force being applied upwardly by cam 314 is being resisted beyond a specified safe limit. This is accomplished by mounting motor mount 310 pivotally about pin 353 which is fixed to an extension arm 397 welded to post weldment 309 supporting the entire mechanism within machine frame 316.

At the free end of extension arm 397 is a pulley 320 rotatably mounted to support a cable 354 suspending a counterweight 352. Counterweight 352 is chosen to apply a prescribed amount of force to cable tie point 355 on motor mount 310 so as to urge motor mount 310 to pivot about motor mount pivot pin 353 and bring into effect the camming action between the periphery of rising plate cam 314 and cam follower 311. If a swing arm 305, for example, becomes loosened and jams against the bottom of top plate 315, or for other safety reasons, without this safety feature cam 314 would tend to continually push upwardly on cam follower 311 despite the malfunction. In the arrangement shown, however, as the force is applied upwardly against cam follower 311 and the prescribed limitation of upwardly directed force is reached, further rotation of rising plate cam 314 merely causes a lifting of counterweight 352 over pulley 320, and the consequent lowering of the motor mount assembly as cam 314 continues to rotate, as would be readily understood by an ordinary mechanic.

Assuming that no malfunction has taken place, rotation of rising plate cam 314 causes cam follower 311 to exert an upwardly directed force against cam follower mounting block 351 which, in turn, causes rising plate 308 to rise. As it does, lever wheels 307, being rotatably mounted radially outwardly of the pivot points of lever arms 306 (on pivot slide 302) move radially outward. This causes the upper end of lever arms 306 to slide in the slots 344 in swing arms 305, and because swing arms 305 are pivoted to fixed points 340 at their inner ends, they begin to pivot upwardly, as shown by the dashed lines in FIG. 16, until they contact the mold or flower pot 325. Swing arms 305 pass through openings 398 (FIG. 18) incised in top plate 315 in a manner already described in connection with the apparatus of FIGS. 1–15. In the closed position (dashed in FIG. 16) of swing arms 305, the sheet of material is in engaging conformal contact with the die mold or flower pot 325, and, depending upon the nature of the sheet of material and the desired final product, a flower pot or flower pot cover is thus formed.

Figure 18:
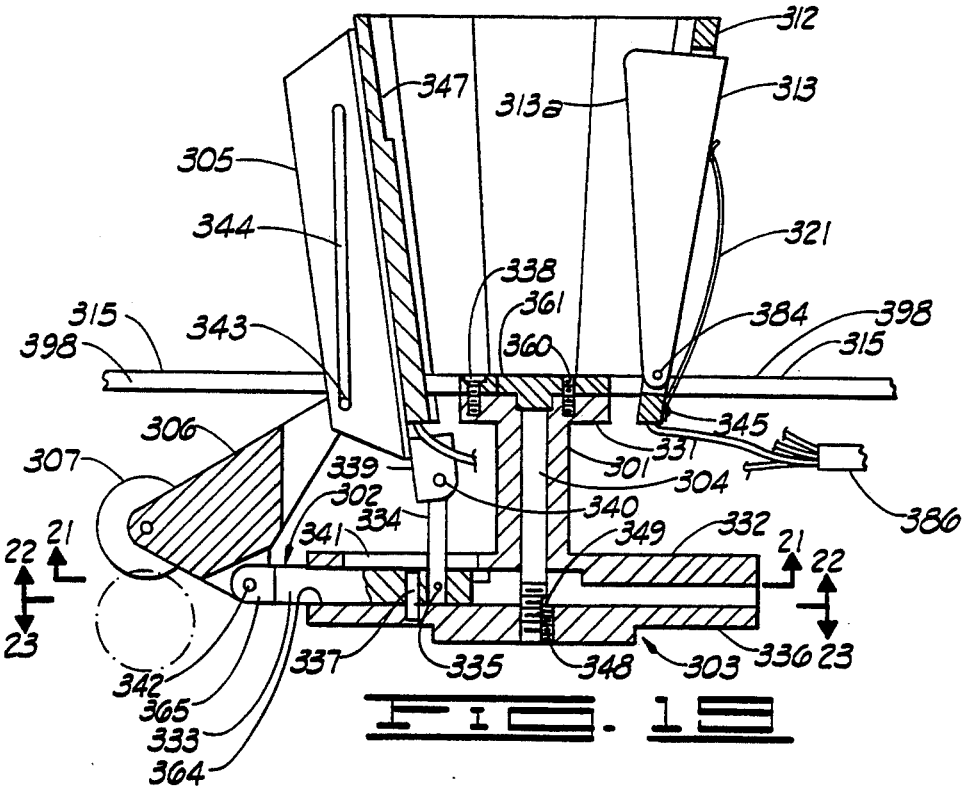
FIG. 18 is a top plan view of the apparatus shown in FIG. 16.

FIG. 18 shows a top elevation view of the apparatus of FIG. 16 wherein it can be seen that, on each swing arm 305, there is secured a wedge shaped forming shoe 312 configured so as to form a substantially continuous forming surface when in the closed position of the swing arms 305. Importantly, in the embodiment of FIGS. 16–23, the dimensions of the forming shoes 312, widthwise, is such that, when the swing arms 305 bring the forming shoes 312 into contact with the mold or pot 325, a gap exists between the side edge surfaces of adjacent forming shoes 312. This is observable in the drawing of FIG. 20 where a gap 363 is shown between adjacent forming shoes 312. Swing arms 305 are shown as having a substantial "T" cross section, and a number of gathering fingers 313 are shown the function of which will be understood in connection with the next-described embodiment. The gathering fingers 313 form no part of this first-described embodiment of FIGS. 16–23.

Forming shoes 312 may be provided with a relief segment 347 to accommodate the upper, thicker, extension collar of a flower pot (see also the cross sectional view of FIG. 19).

Also, as seen in FIG. 18, the inner ends 339 of swing arms 305 are saddle shaped to accommodate the pivot head of pivot rods 334 shown in FIG. 19. These pivot rods 334 are movable, as an assembly, to selective radially fixed positions (described below) so as to, in turn, move radially inwardly and outwardly as desired, the pivot points for the swing arm mounting saddles 339. In the drawings of FIGS. 16–23, the pivot rods 334 are positioned to accommodate the forming of a cover for a 4" pot or mold.

Figure 20:
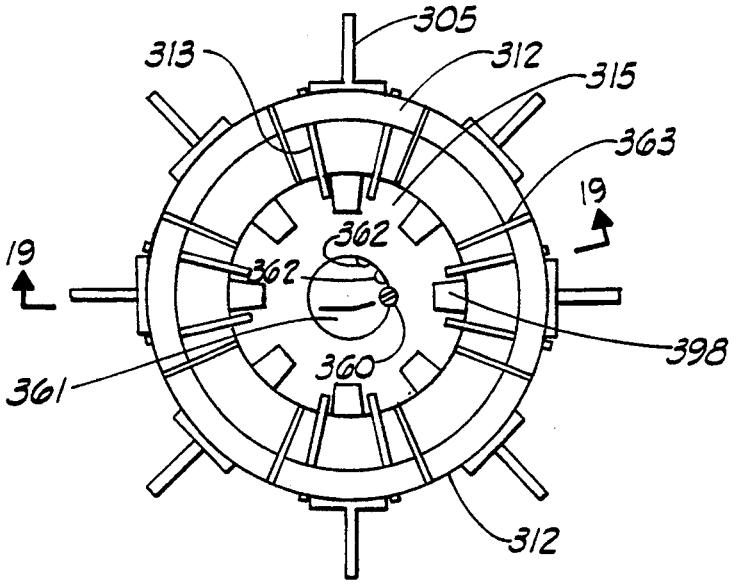
FIG. 20 is a top plan view of the major components of the cover forming apparatus shown in FIG. 19.

More particularly with respect to FIG. 19, this is a cross sectional view of the closed position of swing arms 305 taken along the lines 19—19 in FIG. 20. In FIG. 19, top plate 315 is shown to have cutouts 398 for the swinging through of swing arms 305, and associated apparatus, from beneath the top plate 315 in an initial position to above it in the closed position shown in FIG. 19. This leaves the center portion of top plate 315 to provide a solid support for mounting center hub 301 by means of screws 338. In the center of hub 301 is an alignment shaft 304 having a head 361 rotatable within the center hole of top plate 315. The alignment shaft 304 is secured into a locked position against rotation, however, by the provision of an adjustment plate set screw 360 which fits half within a threaded notch in head 361 and half within a threaded notch in top plate 315 and through to a tapped hole in hub flange 331. This locks alignment shaft 304 with respect to center hub 301. Set screw 360 is removable, allowing alignment shaft 304 to be rotated a prescribed angular amount relative to center hub 301 and then fixed into position again by the setting of set screw 360. This function can be best appreciated by reference to FIG. 20 wherein three different threaded notches 362 are shown to be provided in the head 361 of alignment shaft 304, and a single threaded half circle notch is provided in top plate 315. This permits set screw 360 to position shaft 304 relative to center hub 301 in three discrete incremental angular positions. As will be seen later, these three positions set the apparatus to accommodate different diameters of flower pots or molds to the 4", 6", or 10" dimension mentioned previously.

At the bottom threaded end of alignment shaft 304, an adjustment plate 336 is secured. Relative rotation between shaft 304 and plate 336 is prevented by a cutout 349 in the bottom of shaft 304 and the setting of set screw 348 to lock the adjustment plate 336 to alignment shaft 304 against relative angular movement.

A number of elongated slide bars 333 are sized to freely slide in slide bar grooves 364. This is best observed by reference to FIG. 22 which is an upward view of the hub base 332 taken along lines 22—22 in FIG. 19. The slide bar grooves 364 are milled out to accommodate the slide bars 333 in a close by sliding relationship. When the apparatus is set for any particular size of mold or pot to be covered, for example the 4" pot, index pins 337, (see FIG. 19) which are fixed at a specified radial position by adjustment plate 336, prevent slide bars 333 from sliding in grooves 364. Thus, pivot rods 334, which project through slots 341 in hub base 332 terminate a distance above hub base 332, at which point they form a pivot head about which swing arm mounting saddles 339 are pivoted (about pivot pin 340).

Because slide bars 333 are attached to pivot rods 334 by pivot rod fasteners 335, the narrowed ends 365 of slide bars 333 locate all of the aforementioned pivot pins 342 at a fixed radial distance from the center of hub 301, such that lever arms 306 pivot upon the vertical movement of lever wheels 307.

As indicated, the apparatus of FIG. 19 can accommodate various diameters of pots or molds to be covered, and the adjustment disk assembly 303 functions to accomplish this. The procedure for changing from a 4" pot size to a 6" or 10" pot size is as follows. First, set screw 360 is removed, thereby permitting adjustment plate 336, fixed to adjustment shaft 304, to be rotated relative to hub 301. In adjustment plate 336, a number of specially shaped index pin guide slots 366 are formed (see FIG. 23). Each guide slot 366 has three linear segments, each segment being effective to position index pins 337 to a different radial position relative to the center of adjustment shaft 304.

Figure 22:
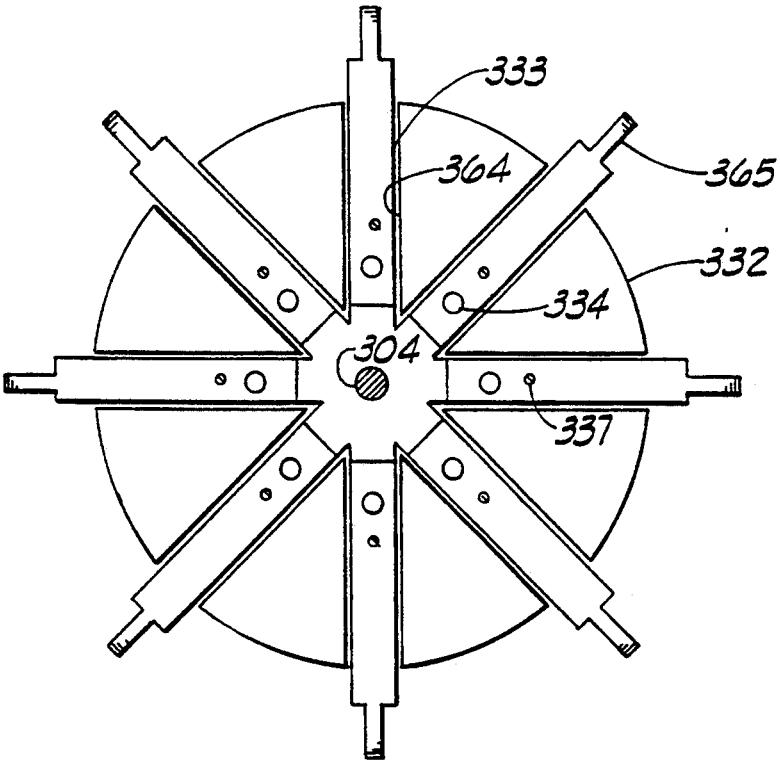
FIG. 22 is a view of the hub base showing a number of slide bars cooperating with the hub base as would be viewed along the line 22—22 in FIG. 19.
Figure 23:
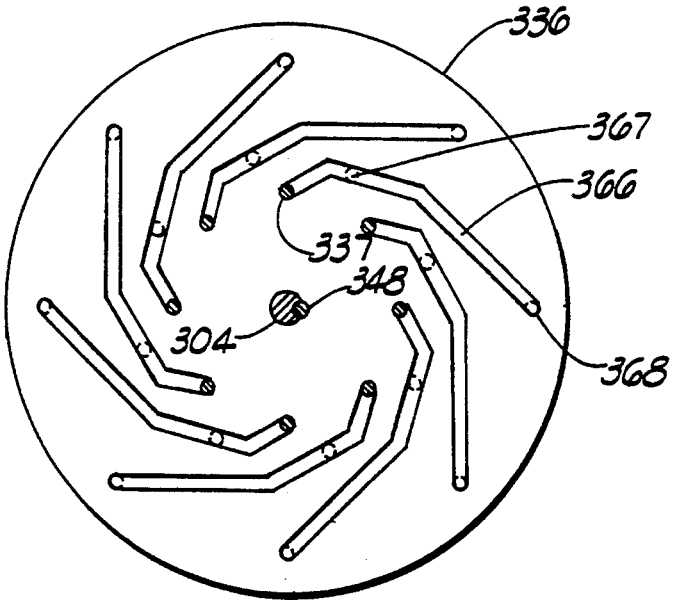
FIG. 23 is a view of the adjustment plate taken along the line 23—23 in FIG. 19.

In FIG. 23, the solid circles show the initial position of index pins 337 to accommodate a 4" pot. By rotating adjustment plate 336, and recognizing that center hub 301 with hub base 332 is fixed against relative rotational movement, this forces index pins 337 to slide in guide slots 366 which, in turn, slides slide bars 333 radially outwardly in slide bar grooves 364 (FIG. 22). Setting the rotation angle of adjustment plate 336 to the next angular position of set screw 360 will position the index pins 337 at the location of the index pins for a 6" pot as shown by reference numeral 367 in FIG. 23. Further rotation of adjustment plate 336 forces index pins 337 further outwardly to the end positions 368 as shown in FIG. 23. This latter positioning accommodates a 10" pot. Since there will be considerable radial pressure applied against the slide bars 333 by the pivoting action of lever arms 306, it is necessary to orient the index pin guide slots 366, to the extent possible, at some angle substantially perpendicular to a radius passing through the index pin at that indexed position. This accounts for the three-segment configuration of index slots 366 as shown in FIG. 23.

Figure 21:
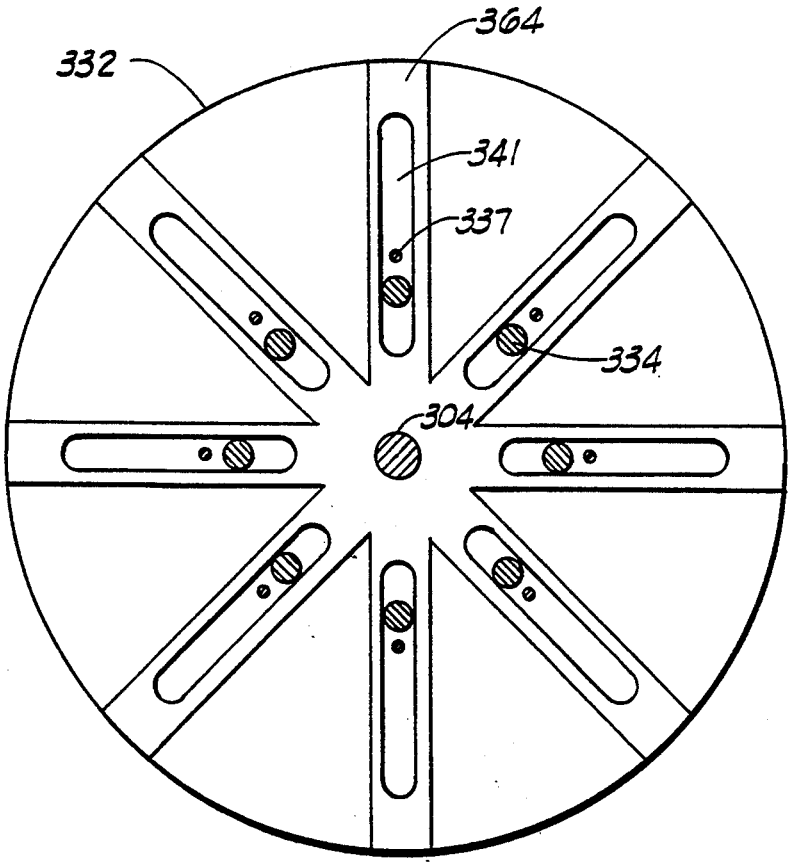
FIG. 21 is a view of the hub base taken along the line 21—21 of FIG. 19.

FIG. 21 shows the view taken along the lines 21—21 in FIG. 19 and particularly shows the hub base slot 341 through which pivot rods 334 project and move when adjustment plate 336 is manipulated to make the appropriate pot size adjustment.

In operation, the cover forming apparatus is initially set in the fully opened position as seen in FIGS. 16–18. A sheet of material is placed on the top surface of plate 315, and a flower pot or mold 325 is placed in the center of the apparatus with the bottom of the pot centered on the top of center hub 301. The pot or mold can be placed in position either manually or automatically by a number of different mechanisms such as those previously described in connection with alternative embodiments of the invention.

An operator then energizes geared motor 319 which causes cam 314 to rotate eccentrically about pivot pin 396. Cam follower 311 follows the surface of cam 314, and the pivoting action of lever arms 306, as previously described, begin to move swing arms 305 upwardly.

Because of the spacing of forming shoes 312 and the choice of sheet material, which is rather flexible, portions of the sheet of material which initially lay flat on top plate 315 are pushed up by shoes 312, while the material portions between shoes 312 lags behind such movement. This condition stays the same as the lever arms 306 and attached shoes 312 continue to rise (pivot). As the shoes rise vertically, they also come closer together, so that the side edges of each shoe ultimately lie adjacent the side edges of adjacent shoes. As indicated earlier, however, gaps 363 (FIG. 20) remain after the shoes are in their fully raised position, at which point it can be appreciated that the sheet of material that is urged by the shoes is placed flat against the mold or flower pot, while the lagging material of the sheet forms pleats that project radially outward from between shoes in the gaps 363. The final product made by this process and this embodiment of the invention is shogun in FIG. 27 as formed cover 393 having flat portions 395 formed by shoes 312 and pleats 394 which projected through gaps 363.

The sheet of material used in forming pot or cover 393 may be selected from the same materials selected for use in the previously described embodiments of FIGS. 1–15. If selected portions of the cover are coated with adhesive, the cover 393 can be attached to a flower pot at least in the area of the flat portions 395. In such a case, the facing surfaces of pleats 394 are not coated with adhesive so as to form a more rounded and pleasing look to the pleats. Alternatively, if the cover 393 is to be formed about a mold 325 and the resulting cover is to be removed from the mold for external use, the facing surfaces of pleats 394 may be coated with adhesive, and the flat inner portions 395 will be absent any adhesive. The cohesion between facing surfaces of pleats 394 will serve to maintain the formed configuration of the cover 393 and yet permit the cover to be removed from the mold 325. A further alternative material for the cover is a settable material which retains its shape upon being formed without the need for adhesives. Such materials are often described as forming "dead folds", since there is little or no elasticity in the material. Such "dead-fold" or "semi-rigid" sheet materials include, but are not limited to, "dead-fold" plastic sheets, wire laminated flexible sheet material, waxed sheet material, and starched or sugared sheet materials. Still other material selections include heat sealable, sonic bondable, or vibration bondable materials. Means may be provided for effecting the desired "forming" using such materials. For example, a heat sealable or sonic bondable cover may be bonded to a flower pot, being used as a mold, and heater or sonic applicator elements may be embedded in forming members such as in forming shoes 312. In heat bonding, either the sheet material itself may be heat bondable, or it can be coated with a heat sealable lacquer.

The second embodiment of FIGS. 16–26 will now be described. In this embodiment, a number of gathering fingers 313 are employed to force the flexible sheet material, from which a cover or pot is to be formed, radially inward and in advance of the foxing members (comprising swing arms 305 with fitted shoes 312) contacting the mold or pot. The details of the forming fingers 313 will be apparent by reference to FIGS. 18, 19, 20, and 24–26. FIG. 18 shows a pair of gathering fingers 313 associated with four of the swing arms 305, where the gathering fingers 313 are positioned adjacent the outer edges of the shoes 312. This would place the gathering fingers in the location of the gaps 363 earlier described in connection with FIG. 20. However, FIG. 20 shows an alternative arrangement of the gathering fingers 313 straddling each side of swing arms 305 but circumferentially inward toward arms 305 than the position of gaps 363. The number of gathering fingers and their locations will determine the pattern ultimately formed on the outside of the pot or pot cover, and it is to understood that there is no limitation as to the number or placement of such gathering fingers. It is only required that the gathering fingers operate to produce predictable conditioning of the sheet of material prior to the pressing of the sheet of material against the outside of the mold or flower pot upon full closure of the forming members.

Figure 24:
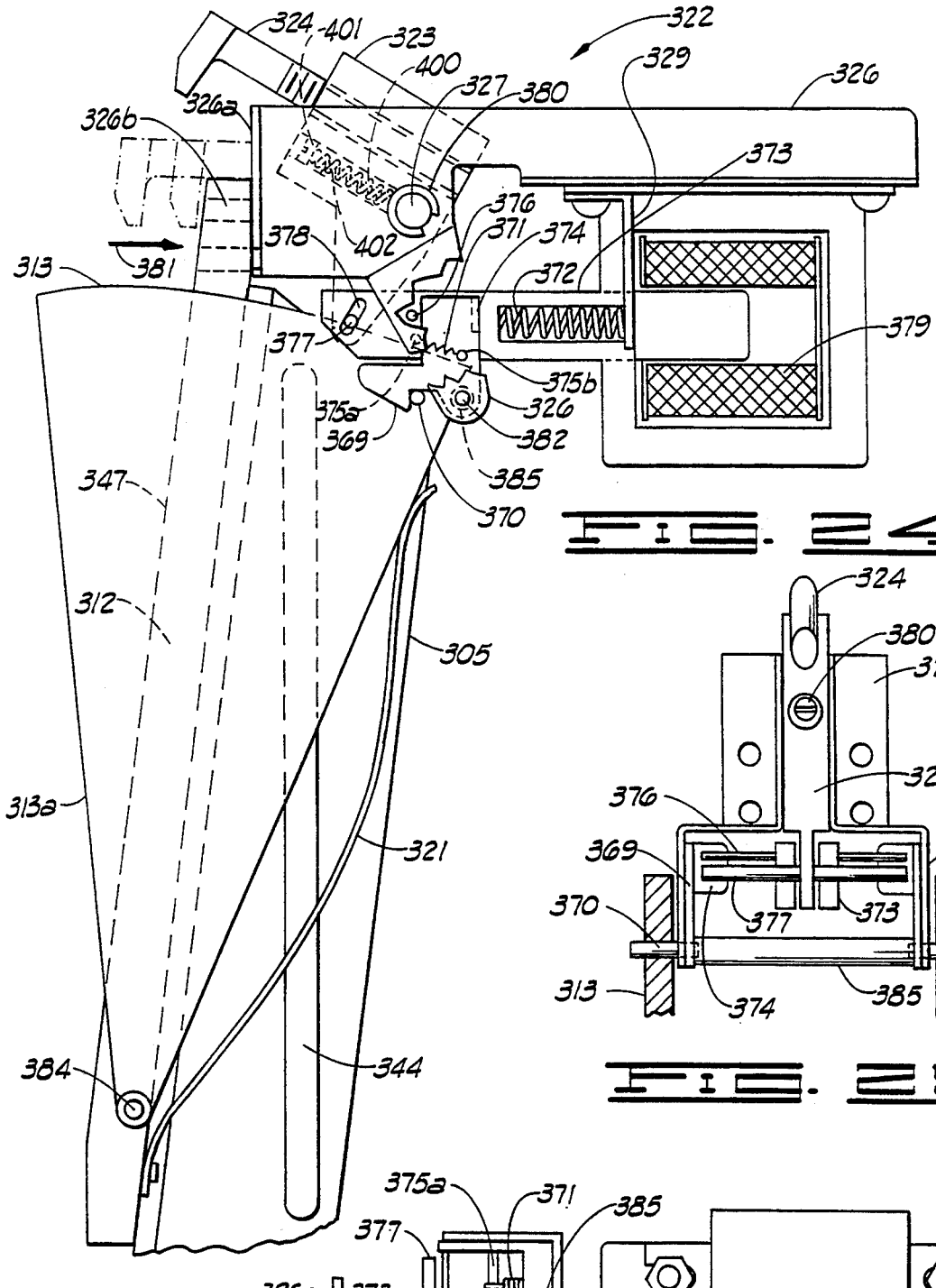
FIG. 24 is a side view of a swing arm/gathering finger/gathering clamp unit arrangement which comprises all or selected ones of the forming members.

The basic operation of gathering fingers 313 is as follows. Initially, the gathering fingers are held in a position away from the mold or pot so that their front edges **313*a* (FIG. 24) lie adjacent to (preferably, but not limited to, a little in advance of forming shoes 312) or in line with the inner surfaces of forming shoes 312. This would be the condition of the gathering fingers in the initial position of swing arms 305 as seen, for example, in FIG. 24 where edges 313*a* project approximately one-third the maximum distance of penetration of gathering fingers 313 beyond the outer surfaces of forming shoes 312. It should be noted that the arrangement of FIG. 24 is shown with the gathering fingers 313 in the initial or unreleased state. That would be the condition at the beginning of the forming process when the forming members are below the top plate 315 and begin to rise, which condition exists until the forming members are at a predetermined angle before closure. Accordingly, the view of the apparatus of FIG. 24 is shown substantially vertical for convenience of drawing only, and it will be appreciated that the fingers 313** would actually be released in such vertical position.

As the swing arms 305 are lifted to form the sheet of material about the mold or pot 325, both the gathering fingers 313 and forming shoes 312 push the sheet of material upwardly. At a prescribed interim position of swing arms 305, the gathering fingers 313 are released from their held position, and pretensioned gathering finger springs 321 push the fingers 313 inwardly to likewise advance the sheet material contacting the forward edges 313*a* further inwardly than the remainder of the material adjacent the forming shoes 312. This forms a predetermined, preferably uniform, pattern of inwardly directed pleats in the sheet material.

As the swing arms 305 continue to move upwardly toward their closed positions, the sheet material being advanced by the leading edges 313*a* is formed into inwardly directed pleats which contact the mold or flower pot 325 first. Due to the strength of spring 321 applying an inwardly directed force on fingers 313 being less than the force being applied to close the swing arms 305, fingers 313 begin to retract toward their initial position. As they do, forming shoes 312 continue to move toward the mold or flower pot, and at the end of the process, a pattern of overlapping folds will be formed against the mold or pot surface, but on the inside of a formed pot or pot cover. The outside surface of the formed pot or pot cover will thus show simple, uniformly spaced, fold lines extending from the bottom to the top of the pot or cover, such fold lines being the parallel edges of the bases of the inwardly directed pleats. It can be appreciated that, with the initial contact of specified portions of the sheet with the mold or pot by the gathering fingers 313, a predicable pattern of internal overlapping folds will result. The folds can be kept loose, or bonded together and/or bonded to the portion of the sheet material pressing against the mold or pot, and this fixing of the overlapping folds is accomplished by a number of possible processes, including the use of adhesive or coadhesive surfaces, the use of heat sealable materials, sonic welding, and the like as previously described.

FIGS. 28 and 29 show two configurations of a pot or cover formed with the use of gathering fingers 313. Pot or cover 388 is without a skirt, and pot or cover 391 is shogun having been formed with a skirt portion 392. Each pot or cover has internal overlapping folds 390 and 390*a* defining rather predictable fold lines 389 to create an aesthetically pleasing design for the pot or cover.

Forming the pots or covers as just described using gathering fingers 313 may result in the folds, although uniformly spaced, being randomly folded to one side or the other or pressed straight back and having areas lying on both sides of the fold line 389. These folds, although interior to the formed pot or cover, may be visible from the outside of the pot or cover, especially if "dead fold" materials are used or the sheet material is translucent. In order to make the design appearance even more uniform, apparatus may be readily provided to rotate the mold or pot 325 (FIG. 16) at least subsequent to the initial contact of the sheet material by the gathering fingers 313. A simple electromechanical arrangement (not shown) can be easily devised to cause the pot or mold 325 to begin rotation at the appropriate time. For simplicity, and having illustrated a mobile pot or cover forming apparatus in FIG. 16, a manually rotatable handle 399 connected to mold 325 can accomplish the desired results in a manual operation. If an electromechanical arrangement is desired, the initiation of the rotation of mold 325 may begin upon the closure of a contact switch set to close at a prescribed angular position of the rising plate cam 314 relative to motor mount 310, for example.

In this connection, the timing of the release of the gathering fingers 313 as described earlier can also be timed by the closure of a switch actuated by the relative angular movement between cam 314 and motor mount 310. Implementing such features into the present invention involves only simple application of electromechanical design, and no detailed description is therefore given or deemed necessary.

In any event, rotational movement of the mold or pot 325 by handle 399, as the gathering fingers 313 press the sheet material into contact, will force the overlapping folds to lay over in a predictable manner, and the resulting pattern (FIG. 28) shows a more uniform distribution of any externally visible overlapping folds. Without relative rotation of the mold and sheet material during the forming process, the internally projected portions of the sheet, pushed in by the gathering fingers 313, with typically be pushed radially straight back against the forming shoes 312 to form a rather predictable internal double overlapping fold 390*a* shown in FIG. 29.

The sheet of material may be wholly adhesively coated or coated in selected areas, depending upon the desired pattern effect in the finished product. When the cover is to be fixed to a flower pot, pot cover and pot may be adhesively coated, such that the cover and pot coadhere upon completion of the forming process. When desired, adhesives and/or coadhesives may be applied, so that such coated surfaces will adhere to certain surfaces (coated or uncoated) but not to themselves. Alternatively, it may be advisable to seal the overlapping folds of the pot or cover according to FIGS. 28 and 29 by means of a thermal heat setting operation, a sonic weld operation, or a vibratory action. It may, instead, be desirable to seal all parts of the cover except the overlapping folds. In any case, a device for carrying out the necessary function must be applied at the desired contact area of the completely formed sheet of material against the mold. One way of accomplishing this objective is to provide the necessary apparatus (heat pads, sonic actuator elements or other vibrators) within the forming shoes 312 themselves.

FIG. 19 shows a cable 386 having electrical leads feedings the bottom of forming shoes 312 within which the necessary heating, sonic, or vibrating devices are located (not shown in detail in the drawing). Alternatively, instead of dealing with the problems that may be encountered by attempting to feed electrical energy to the moving swing arms 305, the heating, sonic, and/or vibrator devices may be inserted within the mold 325 itself as shown at 328 in FIG. 16. An electrical cable 387 can supply the necessary electrical energy.

Instead of, or in addition to, the sheet of material being heat sealable, heat sealable lacquers may be applied to adhere the material to itself or to a flower pot.

The operation of the gathering fingers will now be described in connection with FIGS. 24–26.

As mentioned earlier, the gathering fingers are triggered to swing inwardly at a prescribed vertical angle of the swing arms 305. The gathering fingers 313 are positioned laterally of the longitudinal center line of the arms 305. With this arrangement, the leading edges 313*a* of the fingers would tend to push more of the sheet of material toward the mold than just that portion of the material in the vicinity of the fingers. Therefore, in order to form even more predictable folds in the resulting product, it would be advantageous to hold back the portion of the sheet material between gathering fingers 313, and for that purpose a gathering clamp unit 322 is provided having a clamp arm 324 which, when activated, holds the upper edge of the sheet material against the inner surface of the shoe 312 as the gathering fingers 313 swing inwardly.

FIG. 24 shows the gathering clamp unit 322 having a clamp assembly frame 326 with a flanged nose portion 326*a* for mounting to the rear of the top of forming shoe 312 by means of screws 326*b* or other appropriate fastening means. A separate clamp unit 322 is therefore provided for each shoe 312 with which gathering fingers 313 are associated. In the example of FIGS. 18 and 20, only four sets of gathering fingers are illustrated, one set for alternate shoes of the eight shoes shown. Obviously, each shoe can mount a clamp unit 322 if desired.

It is intended that FIG. 24 illustrate the condition of the apparatus just prior to release of the gathering fingers 313 as the swing arms 305 reach the aforementioned predetermined vertical position. Such predetermined position will generally be between 10° and 45° with respect to the vertical sloping edge of the mold or pot. As alluded to earlier, the arrangement in FIG. 24 is shown with the clamp unit 322 horizontal for convenience only.

As shown, gathering finger 313 is pivotally mounted to forming shoe 312 by a gathering finger pivot pin 384 and is urged inwardly by spring 321. Gathering finger 313 is prevented from moving inwardly, however, by the fact that a latch pin 370 secured to gathering finger 313 is captured by finger latch 369 which is pulled into latching position by a tension spring 371 having one end connected to a boss 375*b* fixed to the latch 369 itself, and the other end connected to a boss 375*a* extending from and fixed to an extension of clamp assembly frame 326. With finger latch 369 pivotally mounted about pivot pin 382, spring 371 ensures that latch pin 370 is securely captured by finger latch 369.

In this condition, prior to release of gathering finger 313, clamp 324, projecting from clamp pivot member 323, is in its initial raised position as shown in solid lines in FIG. 24. Clamp pivot member 323 is pivoted about pin 327 secured to the frame 326 by means of pivot pin C-clamps 380.

Figure 25:
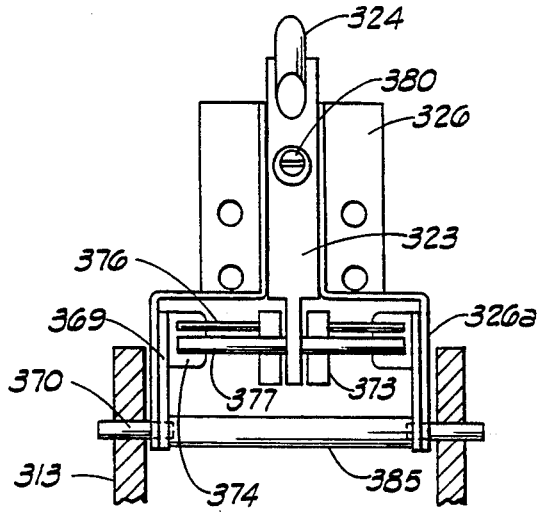
FIG. 25 is a front view of the important functional elements as would be seen at the top of a left elevation view of FIG. 24.
Figure 26:
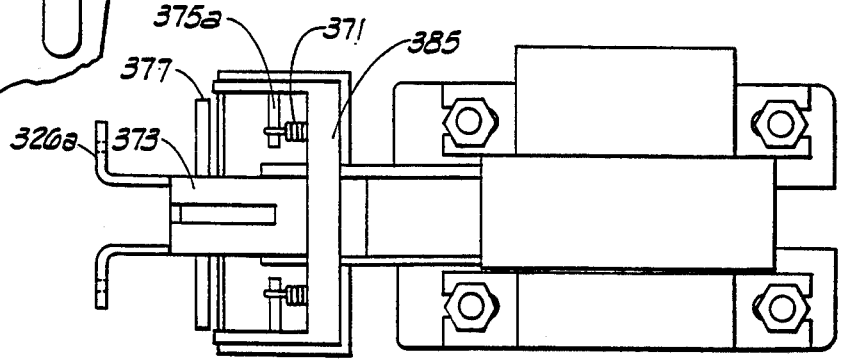
FIG. 26 is a top view of the apparatus of FIG. 24.

As best shown in FIGS. 25 and 26, the gathering finger latches 369 on either side of the shoe 312 are joined together by a common shaft 385 for simultaneous operation. These figures also show the clamp assembly frame nose 326a in a frontal and top view.

The position of swing arms 305, as they rise during the cover forming operation, have a direct relationship to the relative angular position of the raising plate cam 314 and motor mount 310 as indicated earlier. At a prescribed relative angular position between these latter two members, an electrical switch is actuated. Such an arrangement is not shown, since it involves only fundamental engineering design well within the grasp of an ordinary person skilled in the art. In any event, at some "predetermined position" of the swing arms 305, a solenoid 329 mounted to clamp assembly frame 326 is energized. Solenoid 329 has a solenoid coil 379 which, when energized, pulls plunger/actuator 373 to the right, against the force of compression spring 372, as seen in FIG. 24. Solenoid 329 is fixed to frame 326 by means of a mounting bracket 329.

As plunger/actuator 373 is drawn into coil 379, two basic operations occur substantially simultaneously. First, solenoid plunger/actuator 373 moves clamp actuating pin 377 to the right as seen in FIG. 24. This causes clamp pivot member 323 to pivot about pin 327 and move clamp 324 downwardly to the left hand position shown in dashed lines in FIG. 24. With continued movement of plunger/actuator 373 to the right, clamp actuating pin 377 continues to pull pivot member 323 to the right. Slot 378 is provided to allow linear movement of pin 377 toward the solenoid 329 while pivot member 323 rotates about pivot pin 327. With continued movement of the solenoid plunger/actuator 373, pin 377 tends to urge pivot member 323 further to the right. Since this is a desired function to further clamp the sheet of material against the inner surface of forming shoes 312, the clamp pivot pin 327, being fixed to frame 326, is permitted to slide in a slot 402 in member 323 against the compression force of a cushion spring 400 the compression force of which is adjustable by a clamp cushion adjustment screw 401. Thus, after clamp 324 reaches the dotted position to the left in FIG. 24, pin 377 is effective to cause continued movement of pivot member 323 in the right hand direction, as indicated by arrow 381, such that member 323 is forced against spring 400 to continue to move linearly to the right and stop against a sheet of material pressed against the top of forming shoe 312 as shown by the right hand position of dashed lines in FIG. 24.

As described, before release of the gathering fingers 313, the forming shoes 312 move the sheet material toward the mold or flower pot which causes the sheet to move upwardly on the shoe 312. At this time, the sheet also lies relatively flat against shoe 312. At the "predetermined position" of swing arm 305, clamp 324 begins to pivot downwardly due to the fact that pin 377 is acted upon immediately by the right directional movement of plunger/actuator 373, while latch pin actuating boss 376 has not yet reached tab 374. Clamp 324 then reaches the position shown in dashed lines to the left in FIG. 24, and continued movement of the plunger/actuator 373 moves clamp 324 to the right against the action of spring 400 and clamps the sheet of material against the shoe 312.

Substantially simultaneously with this action, the latch pin actuating boss 376 moves to the right and engages latch pin tabs 374, causing latch 369 to pivot about pin 382 and release latch pin 370 from its captured condition. Spring 321 then forces gathering fingers 313 forwardly or inwardly toward the mold or lower pot being covered. In this manner, the sheet of material is secured against forming shoes 312 and against inward movement which would otherwise be caused by the gathering fingers 313 being projected inwardly. This restraint of the area of the sheet of material between gathering fingers contributes to the controlled forming of the internal overlapping folds of the finally produced product.

Deliberate modification or alteration of certain parts of the gathering finger arrangement will result in different design patterns in the finished product. For example, by limiting the amount of penetration of gathering fingers 313 in advance of forming shoes 312, some of the sheet material will create overlapping folds on the outside surface of the pot or cover, and, again due to the action of the gathering fingers, some of the sheet material will create overlapping folds on the inside of the pot or cover.

Selective bonding techniques will produce, as desired, loose or floppy overlapping folds, sealed or not, and parallel or not to the body of the formed pot or cover.

By preparing the sheets of material with one or more central openings, the formed pot or cover will have a partially closed bottom, i.e. the bottom may have a center hole or a number of spaced holes for aeration or for the passage of excess fluids.

Figure 30:
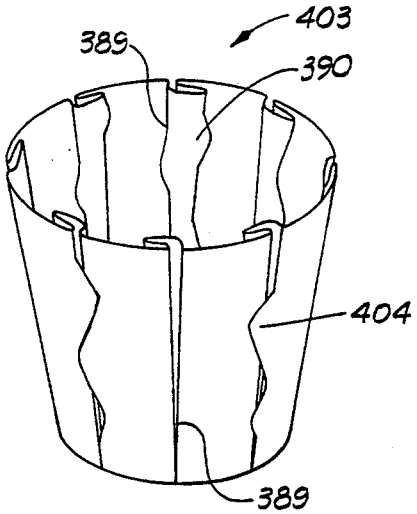
FIG. 30 is a perspective view of a formed flower pot or flower pot cover made using the apparatus shogun in FIGS. 16–26, with both internal and external overlapping folds, and without a skirt portion.

It will be apparent to those skilled in the art that changes may be made in the construction and in the operation of the various components, elements and assemblies described herein, or in the steps or the sequence of steps of the methods described herein, without departing from the spirit and scope of the invention. For example, in the embodiment of the invention which forms outwardly directed pleats in the formed cover (FIGS. 16–23), instead of using adhesives to fix the pleats in place, the side edges of forming shoes may be provided with heat strips, similar to the heat strip or strips used in consumer plastic bag sealers used in many household kitchens today. The strip(s), due to their positions at the edges of the forming shoes 312 will effect seal lines only at the bases of the pleats, adjacent the body of the cover, leaving the looped portions of the pleats unbonded and aesthetically pleasing. Furthermore, for the embodiment of FIGS. 16–26 employing gathering fingers 313, such gathering fingers may, if desired, be continually biased inwardly, i.e. they may not "trigger" at a predetermined angle of the forming members. They would still retract upon contact with the mold or flower pot, however. In addition, the gathering fingers may be employed with or without the clamp assembly 322 being in place or active. It will also be self evident that the method and means for forming pleats in gaps between forming members, as well as the method and means for forming controlled overlapping folds using gathering fingers, are not dependent upon the specific arrangement of rising plate 308, cam 314, wheel guides 350, lever wheels, lever arms, and associated swing arms 305 illustrated. Any method and means for bringing a number of forming members with gaps therebetween into forming position to form outwardly directed pleats, and any method and means for advancing gathering fingers toward the mold or flower pot prior to closure of the forming members, can be employed without affecting the unique features of the resulting flower pot or flower pot cover product. Moreover, both gathering fingers and gapped forming members can be employed in the same forming apparatus to form both internal overlapping folds and outwardly directed pleats in the formed pot or pot cover. Alternatively, the gathering fingers can be spaced apart for enough that external folds or creases are formed in between internally formed overlapping folds (see FIG. 30 showing a formed pot or cover 403, fold lines 389, internal overlapping folds 390, and external overlapping folds 404). The arrangement described herein is merely one example of a preferred embodiment of the invention in these respects. Accordingly, the invention is to be interpreted only as to the scope of the appended claims.

What is claimed is:

1. A cover forming apparatus for forming a flower pot or flower pot cover about an outer surface of an object, the object selected from a group consisting of a die, a mold, and a pot means, from a sheet of material, comprising:

support means upon which the sheet of material is disposable;

an object having an outer surface, said object supported above and near the sheet of material in a forming position;

a plurality of pivotable forming members; and pivoting means coupled to said forming members for pivotally urging said forming members from a storage position spaced a distance from said outer surface and for moving said forming members to a closed position whereby said forming members cooperate to engage portions of the sheet of material and form the sheet material about said outer surface of said object, whereby the sheet of material is formed into the flower pot or flower pot cover; and wherein said forming members include facial surfaces which engage the sheet of material, and edges on each side of said facial surfaces, and wherein said facial surfaces are sized such that, when in said closed position, gaps separate the edges of adjacent forming members, whereby as said forming members are being pivoted from said storage position to said closed position, the non-engaged portions of the material between adjacent forming members lag the movement of the engaged portions, thereby forming a plurality of outwardly directed pleats which project through said gaps when said forming members are in said closed position.

2. The cover forming apparatus of claim 1 further comprising means enabling the cover forming apparatus to be moved from one location to another.

3. The cover forming apparatus as claimed in claim 1, wherein:

said pot means comprises a flower pot;

said apparatus forms a flower pot cover about the outer surface of the flower pot;

said forming members comprise heat sealing elements; and the flower pot and sheet of material are, at least in part, heat sensitive or coated with a heat sensitive lacquer, such that the sheet of material is secured to the outer surface of the flower pot by heat sealing employing said heat sealing elements, said forming members having the capability of being heated to a temperature sufficient to cause the heat sealing of the forming material to the flower pot.

4. The cover forming apparatus as claimed in claim 1, wherein:

said pot means comprises a flower pot;

said apparatus forms a flower pot cover about the outer surface of the flower pot; and said forming members further comprise sonic means for sonically sealing the sheet of material to the outer surface of the flower pot.

5. The cover forming apparatus as claimed in claim 1, wherein:

said pot means comprises a flower pot;

said apparatus forms a flower pot cover about the outer surface of the flower pot; and said sheet of material includes an adhesive material on at least part of the surface portions thereof which engage and adhere to the flower pot.

6. The cover forming apparatus as claimed in claim 1, wherein:

said pot means comprises a flower pot;

said apparatus forms a flower pot cover about the outer surface of the flower pot; and said forming members further comprise vibratory means for vibratingly sealing the sheet of material to the outer surface of the flower pot.

7. The cover forming apparatus as claimed in claim 1, wherein: .

said pot means comprises a flower pot;

said apparatus forms a flower pot cover about the outer surface of the flower pot; and the flower pot is further defined as including an adhesive material on at least portions of the outer surface of the flower pot, whereby, when the sheet of material is brought into contact with the outer surface of the flower pot, the portions of said sheet of material which engage the outer surface of the flower pot adhere to the outer surface of the flower pot.

8. The cover forming apparatus as claimed in claim 1, wherein:

said pot means comprises a flower pot;

said apparatus forms a flower pot cover about the outer surface of the flower pot;

the sheet of material disposable on the support surface further defined as including a cohesive material on at least part of one side of the sheet of material; and the flower pot is further defined as including a cohesive material on at least one portion of the outer surface of the flower pot, whereby when the sheet of material is brought into contact with the outer surface of the flower pot by said forming members, the sheet of material cohesively coheres to the flower pot.

9. A method for forming a flower pot or flower pot cover about an outer surface of an object selected from a group consisting of a die, a mold and a pot means, from a sheet of material, comprising the steps of:

providing a sheet of material;

positioning the sheet of material on a support surface;

supporting the object, having an outer surface, above and near the sheet of material in a mold position; and engaging portions of the sheet of material, and forming the engaged portions of the sheet of material about the outer surface of the object, whereby the sheet of material is formed into the flower pot or flower pot cover;

whereby, as said engaged portions are formed about the object, the non-engaged portions of the material, between the engaged portions, lag the movement of the engaged portions, the non-engaged portions thereby forming a plurality of pleats which project radially outwardly when the engaged portions of the material are brought into engagement with the object.

10. The method as claimed in claim 9, wherein:

said pot means comprises a flower pot, and said method forms a flower pot cover about the outer surface of the flower pot;

the sheet of material is heat sensitive; and said method includes the step of heat sealing the sheet of material to the outer surface of the flower pot.

11. The method as claimed in claim 9, wherein:

said pot means comprises a flower pot, and said method forms a flower pot cover about the outer surface of the flower pot; and said method includes the step of sonically sealing the sheet of material to the outer surface of the flower pot.

12. The method as claimed in claim 9, wherein:

said pot means comprises a flower pot, and said method forms a flower pot cover about the outer surface of the flower pot; and said method includes the step of vibratingly sealing the sheet of material to the outer surface of the flower pot.

13. The method as claimed in claim 9, wherein the material of the sheet of material is selected from the group consisting of: man-made organic polymer films; fibers or fabric (woven or non-woven, synthetic or natural); metallic or non-metallic foils; paper (coated or uncoated, treated or untreated); cellulose (including cellophane); leather; burlap; "dead-fold" or semi-rigid sheet material including "dead-fold" plastic sheets, wire laminated flexible sheet material, waxed sheet material, starched or sugared sheet material; and laminations or combinations thereof.

14. The method as claimed in claim 9, wherein the sheet of material has an adhesive material on at least part of the facing surface portions of the pleats, and the sheet of material substantially retains its shape by the contacting facing surface portions which are securely connected to each other, and the shape is further maintained when the cover thus formed is removed from the object.

15. The method as claimed in claim 9, wherein the sheet of material is further defined as being formable into shapes and as being settable, so that the cover is self supporting and substantially retains its shape after it is formed and is removed from the object.

16. The method as claimed in claim 9, wherein:

said pot means comprises a flower pot, and said method forms a flower pot cover about the outer surface of the flower pot; and the sheet of material includes an adhesive material on at least part of the surface portions thereof which engage and adhere to the flower pot.

17. The method as claimed in claim 16, wherein said adhesive material includes a pressure sensitive adhesive material on at least a portion of the side of said sheet of material to be engaged with the outer surface of the flower pot, so that the portions of said sheet of material which engage the outer surface of the flower pot adhere to the outer surface of the flower pot, and the portions of the sheet of material which form the pleats do not adhere.

18. The method as claimed in claim 9, wherein:

said pot means comprises a flower pot, and said method forms a flower pot cover about the outer surface of the flower pot; and the flower pot is further defined as including an adhesive material on at least portions of the outer surface of the flower pot, whereby, when the sheet of material is brought into contact with the outer surface of the flower pot, the portions of said sheet of material which engage the outer surface of the flower pot adhere to the outer surface of the flower pot.

19. The method as claimed in claim 9, wherein:

said pot means comprises a flower pot, and said method forms a flower pot cover about the outer surface of the flower pot;

the sheet of material disposable on the support surface is further defined as including a cohesive material on at least part of one side of the sheet of material; and the flower pot is further defined as including a cohesive material on at least one portion of the outer surface of the flower pot, whereby when the sheet of material is brought into contact with the outer surface of the flower pot, the sheet of material cohesively coheres to the flower pot.

20. A cover forming apparatus for forming a flower pot or flower pot cover about an outer surface of an object, the object selected from a group consisting of a die, a mold and a pot means, from a sheet of material, comprising:

support means upon which the sheet of material is disposable;

an object having an outer surface, said object supported above and near the sheet of material in a forming position;

a plurality of pivotable forming members;

pivoting means coupled to said forming members for pivotally urging said forming members from a storage position spaced a distance from said outer surface and for moving said forming members to a closed position wherein said forming members cooperate to engage portions of the sheet of material and form the sheet of material about said outer surface of said mold; and a plurality of movable fingers cooperating to engage portions of the sheet of material and bring the portions engaged by said fingers into contact with the outer surface of the object in advance of the portions of the sheet of material engaged by said forming members;

whereby the sheet of material is formed into a flower pot or flower pot cover, between the object and said forming members, with the portions engaged by said fingers forming internal overlapping folds in the formed flower pot or flower pot cover in the vicinity of said fingers.

21. The cover forming apparatus as claimed in claim 20, wherein:

said pot means comprises a flower pot;

said apparatus forms a flower pot cover about the outer surface of the flower pot; and said forming members further comprise sonic means for sonically sealing the sheet of material to the outer surface of the flower pot.

22. The cover forming apparatus as claimed in claim 20, wherein:

said pot means comprises a flower pot;

said apparatus forms a flower pot cover about the outer surface of the flower pot; and said forming members further comprise vibratory means for vibratingly sealing the sheet of material to the outer surface of the flower pot.

23. The cover forming apparatus as claimed in claim 20, wherein:

said forming members comprise heat sealing elements; and the sheet of material is, at least in part, heat sensitive or coated with a heat sensitive lacquer, such that the internal overlapping folds of the sheet of material are securely attached to the formed flower pot cover by heat sealing employing said heat sealing elements, said forming members having the capability of being heated to a temperature sufficient to cause the heat sealing of the forming material.

24. The cover forming apparatus as claimed in claim 20, wherein:

said forming members further comprise sonic means for sonically sealing the internal overlapping folds to the formed flower pot cover.

25. The cover forming apparatus as claimed in claim 20, wherein:

said forming members further comprise vibratory means for vibratingly sealing the internal overlapping folds to the formed flower pot cover.

26. The cover forming apparatus as claimed in claim 20, wherein:

said pot means comprises a flower pot;

said apparatus forms a flower pot cover about the outer surface of the flower pot; and said sheet of material includes an adhesive material on at least part of the surface portions thereof which engage and adhere to the flower pot.

27. The cover forming apparatus of claim 20 further comprising means enabling the cover forming apparatus to be moved from one location to another.

28. The cover forming apparatus as claimed in claim 20, wherein:

said pot means comprises a flower pot;

said apparatus forms a flower pot cover about the outer surface of the flower pot; and the flower pot is further defined as including an adhesive material on at least portions of the outer surface of the flower pot, whereby, when the sheet of material is brought into contact with the outer surface of the flower pot, the portions of said sheet of material which engage the outer surface of the flower pot adhere to the outer surface of the flower pot.

29. The cover forming apparatus as claimed in claim 20, wherein:

said pot means comprises a flower pot;

said apparatus forms a flower pot cover about the outer surface of the flower pot;

the sheet of material disposable on the support surface is further defined as including a cohesive material on at least part of one side of the sheet of material; and the flower pot is further defined as including a cohesive material on at least one portion of the outer surface of the flower pot, whereby when the sheet of material is brought into contact with the outer surface of the flower pot by said forming members, the sheet of material cohesively coheres to the flower pot.

30. The cover forming apparatus as claimed in claim 20, wherein:

said pot means comprises a flower pot;

said apparatus forms a flower pot cover about the outer surface of the flower pot;

said forming members comprise heat sealing elements; and the flower pot and sheet of material are, at least in part, heat sensitive or coated with a heat sensitive lacquer, such that the sheet of material is secured to the outer surface of the flower pot by heat sealing employing said heat sealing elements, said forming members having the capability of being heated to a temperature sufficient to cause the heat sealing of the forming material to the flower pot.

31. A method of forming a flower pot or flower pot cover about an outer surface of an object, the object selected from a group consisting of a die, a mold and a pot means, from a sheet of material, comprising the steps of:

providing a sheet of material;
positioning the sheet of material on a support surface;
supporting an object, having an outer surface, above and near the sheet of material in a forming position;
engaging first portions of the sheet material, and bringing the engaged first portions of the sheet material into contact with the outer surface of the object;
engaging second portions of the sheet of material intermediate said first portions and bringing the engaged second portions into contact with the outer surface of the object after engagement of the first portions of the sheet of material;
whereby the sheet of material is formed into a flower pot or flower pot cover, with the first engaged portions forming internal overlapping folds in the formed flower pot or flower pot cover.

32. The method as claimed in claim 31, wherein:
said pot means comprises a flower pot;
said method forms a flower pot cover about the outer surface of the flower pot; and
said method includes sonically sealing the sheet of material to the outer surface of the flower pot.

33. The method as claimed in claim 31, wherein:
said pot means comprises a flower pot;
said method forms a flower pot cover about the outer surface of the flower pot; and
said method includes vibratingly sealing the sheet of material to the outer surface of the flower pot.

34. The method as claimed in claim 31, wherein:
the sheet of material is, at least in part, heat sensitive or coated with a heat sensitive lacquer; and
said method includes securely attaching the internal overlapping folds of the sheet of material to the formed flower pot cover by heat sealing at a temperature sufficient to cause the heat sealing of the forming material.

35. The method as claimed in claim 31, including the step of sonically sealing the internal overlapping folds to the formed flower pot cover.

36. The method as claimed in claim 31, including the step of vibratingly sealing the internal overlapping folds to the formed flower pot cover.

37. The method as claimed in claim 31, wherein the material of the sheet of material is selected from the group consisting of: man-made organic polymer films; fibers or fabric (woven or non-woven, synthetic or natural); metallic or non-metallic foils; paper (coated or uncoated, treated or untreated); cellulose (including cellophane); leather; burlap; "dead-fold" or semi-rigid sheet material including "dead-fold" plastic sheets, wire laminated flexible sheet material, waxed sheet material, starched or sugared sheet material; and laminations or combinations thereof.

38. The method as claimed in claim 31, wherein the sheet of material is further defined as being formable into shapes and as being settable, so that the cover is self supporting and substantially retains its shape after it is formed and is removed from said object.

39. The method as claimed in claim 31, wherein:
said pot means comprises a flower pot;
said method forms a flower pot cover about the outer surface of the flower pot; and
said sheet of material includes an adhesive material on at least part of the surface portions thereof which engage and adhere to the flower pot.

40. The method as claimed in claim 39, wherein said adhesive material includes a pressure sensitive adhesive material on at least a portion of the side of said sheet of material to be engaged with the outer surface of the flower pot, so that the portions of said sheet of material which engage the outer surface of the flower pot adhere to the outer surface of the flower pot.

41. The method as claimed in claim 31, wherein:
said pot means comprises a flower pot;
said method forms a flower pot cover about the outer surface of the flower pot; and
the flower pot is further defined as including an adhesive material on at least portions of the outer surface of the flower pot, whereby, when the sheet of material is brought into contact with the outer surface of the flower pot, the portions of sheet of material which engage the outer surface of the flower pot adhere to the outer surface of the flower pot.

42. The method as claimed in claim 31, wherein:
said pot means comprises a flower pot;
said method forms a flower pot cover about the outer surface of the flower pot;
the sheet of material disposable on the support surface is further defined as including a cohesive material on at least part of one side of the sheet of material; and
the flower pot is further defined as including a cohesive material on at least one portion of the outer surface of the flower pot, whereby when the sheet of material is brought into contact with the outer surface of the flower pot, the sheet of material cohesively coheres to the flower pot.

43. The method as claimed in claim 31, wherein:
said pot means comprises a flower pot;
said method forms a flower pot cover about the outer surface of the flower pot;
the flower pot and sheet of material are, at least in part, heat sensitive or are coated with a heat sensitive lacquer; and
said method includes securing the sheet of material to the outer surface of the flower pot cover by heat sealing at a temperature sufficient to cause the heat sealing of the forming material to the flower pot.

44. A cover forming apparatus for forming a flower pot or flower pot cover about an outer surface of an object, the object selected from a group consisting of a die, a mold, and a pot means, from a sheet of material, comprising:
support means upon which the sheet of material is diposable;
an object having an outer surface, said object supported above and near the sheet of material in a forming position;
a plurality of pivotable forming members;
pivoting means coupled to said forming members for pivotally urging said forming members from a storage position spaced a distance from said outer surface and for moving said forming members to a closed position wherein said forming members cooperate to engage portions of the sheet of material and form the sheet of material about said outer surface of said object; and
a plurality of movable fingers cooperating to engage portions of the sheet of material and bring the portions engaged by said fingers into contact with the outer surface of the object in advance of the portions of the sheet of material engaged by said forming members;

wherein said forming members include facial surfaces which engage the sheet of material, and edges on each side of said facial surfaces, and wherein said facial surfaces are sized such that, when in said closed position, gaps separate the edges of adjacent forming members, whereby as said forming members are being pivoted from said storage position to said closed position, the non-engaged portions of the material between adjacent forming members lag the movement of the engaged portions, thereby forming a plurality of outwardly directed pleats which project through said gaps when said forming members are in said closed position; and whereby the sheet of material is formed into a flower pot flower pot cover, between the object and said forming members, with the non-engaged portions forming outwardly directed pleats, and with the portions engaged by said fingers forming internal overlapping folds in the formed flower pot or flower pot cover in the vicinity of said fingers.

45. The cover forming apparatus of claim 44 further comprising means enabling the cover forming apparatus to be moved from one location to another.

46. A method of forming a flower pot or flower pot cover about an object selected from a group consisting of a die, a mold, and a pot means, comprising the steps of:

providing a sheet of material;

positioning the sheet of material on a support surface;

supporting an object, having an outer surface, above and near the sheet of material in a forming position;

engaging first portions of the sheet material, and bringing the engaged first portions of the sheet material into contact with the outer surface of the object;

engaging second portions of the sheet of material intermediate said first portions and bringing the engaged second portions into contact with the outer surface of the object after engagement of the first portions of the sheet of material wherein at least some of those portions of the sheet of material which engage the outer surface of the mold are bondingly connected thereto;

whereby the sheet of material is formed into a flower pot or flower pot cover, with the first engaged portions forming internal overlapping folds in the formed flower pot or flower pot cover, with the second engaged portions forming external overlapping folds in the formed flower pot or flower pot cover.

47. The method of claim 46, wherein the step of providing a sheet of material further comprises providing a sheet having an adhesive or cohesive bonding material disposed thereon for bondingly connecting the sheet of material to the outer surface of the object.

48. The method of claim 46, wherein the adhesive or cohesive bonding material is applied to the sheet of material immediately prior to the step of positioning the sheet of material on a support surface.

49. The method of claim 46, wherein in the step of supporting an object, the object is further defined as having an adhesive or cohesive bonding material disposed upon at least portions of the outer surface of the object for bondingly connecting the sheet of material to the outer surface of the object.

50. A method for forming a flower pot or flower pot cover about an outer surface of an object, the object selected from a group consisting of a die, a mold, and a pot means, from a sheet of material, comprising the steps of:

providing a sheet of material;

positioning the sheet of material on a support surface;

supporting an object, having an outer surface, above and near the sheet of material in a mold position; and engaging first portions of the sheet material, and bringing the engaged first portions of the sheet material into contact with the outer surface of the object;

engaging second portions of the sheet of material intermediate said first portions and bringing the engaged second portions contact with the outer surface of the object after engagement of the first portions of the sheet of material;

whereby, as said engaged portions are formed about the object, the non-engaged portions of the material, between the engaged portions, lag the movement of the engaged portions, the non-engaged portions thereby forming a plurality of pleats which project radially outwardly when the engaged portions of the material are brought into engagement with the object, the sheet of material being formed with the first engaged portions forming internal overlapping folds in the formed flower pot or flower pot cover.

51. A cover forming apparatus for forming a flower pot or flower pot cover about an outer surface of an object, the object selected from a group consisting of a die, a mold, and a pot means, from a sheet of material, comprising:

support means upon which the sheet of material is disposable;

an object having an outer surface, said object supported above and near the sheet of material in a forming position;

a plurality of pivotable forming members;

pivoting means coupled to said forming members for pivotally urging said forming members from a storage position spaced a distance from said outer surface and for moving said forming members to a closed position wherein said forming members cooperate to engage portions of the sheet of material and form the sheet of material about said outer surface of said object; and a plurality of movable fingers cooperating to engage portions of the sheet of material and bring the portions engaged by said fingers into contact with the outer surface of the object in advance of the portions of the sheet of material engaged by said forming members;

whereby the sheet of material is formed into a flower pot or flower pot cover, between the object and said forming members, with the portions engaged by said fingers forming internal overlapping folds in the formed flower pot or flower pot cover in the vicinity of said fingers, and with the portions not engaged by said fingers form external overlapping folds.

52. The cover forming apparatus of claim 51 further comprising means enabling the cover forming apparatus to be moved from one location to another.

53. A method for forming a flower pot or flower pot cover about an object selected from the group consisting of a die, a mold and a pot means, comprising the steps of:

providing a sheet of material;

positioning the sheet of material on a support surface;

supporting the object, having an outer surface, above and near the sheet of material in a mold position; and engaging portions of the sheet of material, and forming the engaged portions of the sheet of material about the outer surface of the object, whereby the sheet of material is formed into the flower pot or flower pot cover and portions of the sheet of material are bondingly connected to the outer surface of the object;

whereby, as said engaged portions are formed about the object, the non-engaged portions of the material, between the engaged portions, lag the movement of the engaged portions, the non-engaged portions thereby forming a plurality of pleats which project radially outwardly when the engaged portions of the material are brought into engagement with the object.

54. The method of claim 53 wherein the step of providing a sheet of material further comprises providing a sheet having an adhesive or cohesive bonding material disposed thereon for bondingly connecting the sheet of material to the outer surface of the object.

55. The method of claim 54 wherein the adhesive or cohesive bonding material is applied to the sheet of material immediately prior to the step of positioning the sheet of material on a support surface.

56. The method of claim 53 wherein in the step of supporting an object, the object is further defined as having an adhesive or cohesive bonding material disposed upon at least portions of the outer surface of the object for bondingly connecting the sheet of material to the outer surface of the object.

57. A method of forming a flower pot or flower pot cover about an object selected from a group consisting of a die, a mold and a pot means comprising the steps of:

providing a sheet of material;

positioning the sheet of material on a support surface;

supporting an object, having an outer surface, above and near the sheet of material in a forming position;

engaging first portions of the sheet material, and bringing the engaged first portions of the sheet material into contact with the outer surface of the object wherein at least some of the engaged first portions of the sheet of material which engage the outer surface of the object are connectingly bonded thereto;

engaging second portions of the sheet of material intermediate said first portions and bringing the engaged second portions into contact with the outer surface of the object after engagement of the first portions of the sheet of material;

whereby the sheet of material is formed into a flower pot or flower pot cover, with the first engaged portions forming internal overlapping folds in the formed flower pot or flower pot cover.

58. The method of claim 57 wherein the step of providing a sheet of material further comprises providing a sheet having an adhesive or cohesive bonding material disposed thereon for bondingly connecting the sheet of material to the outer surface of the object.

59. The method of claim 58 wherein the adhesive or cohesive bonding material is applied to the sheet of material immediately prior to the step of positioning the sheet of material on a support surface.

60. The method of claim 57 wherein in the step of supporting an object, the object is further defined as having an adhesive or cohesive bonding material disposed upon at least portions of the outer surface of the object for bondingly connecting the sheet of material to the outer surface of the object.

61. A method for forming a flower pot or flower pot cover about an object selected from a group consisting of a die, a mold, and a pot means, comprising the steps of:

providing a sheet of material;

positioning the sheet of material on a support surface;

supporting an object, having an outer surface, above and near the sheet of material in a mold position; and engaging first portions of the sheet material, and bringing the engaged first portions of the sheet material into contact with the outer surface of the object wherein at least some of the engaged first portions of the sheet of material which engage the outer surface of the mold are bondingly connected thereto;

engaging second portions of the sheet of material intermediate said first portions and bringing the engaged second portions into contact with the outer surface of the object after engagement of the first portions of the sheet of material;

whereby, as said engaged portions are formed about the object, the non-engaged portions of the material, between the engaged portions, lag the movement of the engaged portions, the non-engaged portions thereby forming a plurality of pleats which project radially outwardly when the engaged portions of the material are brought into engagement with the object, the sheet of material being formed with the first engaged portions forming internal overlapping folds in the formed flower pot or flower pot cover.

62. The method of claim 61 wherein the step of providing a sheet of material further comprises providing a sheet having an adhesive or cohesive bonding material disposed thereon for bondingly connecting the sheet of material to the outer surface of the object.

63. The method of claim 62 wherein the adhesive or cohesive bonding material is applied to the sheet of material immediately prior to the step of positioning the sheet of material on a support surface.

64. The method of claim 61 wherein in the step of supporting an object, the object is further defined as having an adhesive or cohesive bonding material disposed upon at least portions of the outer surface of the object for bondingly connecting the sheet of material to the outer surface of the object.

65. A method of forming a flower pot or flower pot cover about an outer surface of an object, the object selected from a group consisting of a die, a mold, and a pot means, from a sheet of material, comprising the steps of:

providing a sheet of material;

positioning the sheet of material on a support surface;

supporting an object, having an outer surface, above and near the sheet of material in a forming position;

engaging first portions of the sheet material, and bringing the engaged first portions of the sheet material into contact with the outer surface of the object;

engaging second portions of the sheet of material intermediate said first portions and bringing the engaged second portions into contact with the outer surface of the object after engagement of the first portions of the sheet of material;

whereby the sheet of material is formed into a flower pot or flower pot cover, with the first engaged portions forming internal overlapping folds in the formed flower pot or flower pot cover, and with the second engaged portions forming external overlapping folds in the formed flower pot or flower pot cover.

* * * * *

UNITED STATES PATENT AND TRADEMARK OFFICE

CERTIFICATE OF CORRECTION

PATENT NO. : 5,350,473

DATED : September 27, 1994

INVENTOR(S) : Donald E. Weder et al.

It is certified that error appears in the above-identified patent and that said Letters Patent is hereby corrected as shown below:

Column 2, line 61, please delete "shogun" and substitute therefor --shown--.

Column 3, line 64, please delete "16*b*disposed" and substitute therefor --16*b* disposed--.

Column 5, line 25, please delete "men%hers" and substitute therefor --members--.

Column 12, line 35, please delete "men,hers" and substitute therefor --members--.

Column 12, line 50, please delete "men,bets" and substitute therefor --members--.

Column 17, line 48, please delete "shogun" and substitute therefor --shown--.

Column 18, line 23, please delete "foxing" and substitute therefor --forming--.

Column 18, line 39, after the first occurence of the word "to" please insert the word --be--.

Column 19, line 44, please delete "shogun" and substitute therefor --shown--.

UNITED STATES PATENT AND TRADEMARK OFFICE

CERTIFICATE OF CORRECTION

PATENT NO. : 5,350,473

DATED : September 27, 1994

INVENTOR(S) : Donald E. Weder et al.

It is certified that error appears in the above-identified patent and that said Letters Patent is hereby corrected as shown below:

Column 20, line 21, please delete "with" and substitute therefor --will--.

Column 20, line 47, please delete "feedings" and substitute therefor --feeding--.

Column 21, line 55, please delete "raising" and substitute therefor --rising--.

Column 23, line 54, please delete "for" and substitute therefor --far--.

Column 31, line 47, after the word "cover," please insert the word --and--.

Signed and Sealed this

Fourteenth Day of February, 1995

Bruce Lehman

*Attest:*

BRUCE LEHMAN

*Attesting Officer*

*Commissioner of Patents and Trademarks*